US012616314B2

(12) United States Patent
Susswein et al.

(10) Patent No.: US 12,616,314 B2
(45) Date of Patent: May 5, 2026

(54) MULTI-PART DISHWASHER-OPTIMIZED HIGH CHAIR

(71) Applicants: Liam Susswein, Chicago, IL (US); Benjamin Yost, San Diego, CA (US); Kane Feldman, Shawnee, KS (US)

(72) Inventors: Liam Susswein, Chicago, IL (US); Benjamin Yost, San Diego, CA (US); Kane Feldman, Shawnee, KS (US)

(73) Assignees: Liam Susswein, Chicago, IL (US); Benjamin Yost, San Diego, CA (US); Kane Feldman, Shawnee, KS (US)

( * ) Notice: Subject to any disclaimer, the term of this patent is extended or adjusted under 35 U.S.C. 154(b) by 182 days.

(21) Appl. No.: 18/212,132

(22) Filed: Jun. 20, 2023

(65) Prior Publication Data

US 2023/0380604 A1 Nov. 30, 2023

Related U.S. Application Data

(60) Provisional application No. 63/331,857, filed on Apr. 17, 2022.

(51) Int. Cl.

| | |
|---|---|
| ***A47D 1/10*** | (2006.01) |
| ***A47D 1/00*** | (2006.01) |
| ***A47D 15/00*** | (2006.01) |

(52) U.S. Cl.

CPC ..... *A47D 1/006* (2013.01); *A47D 15/006* (2013.01); *A47D 1/10* (2013.01)

(58) Field of Classification Search

CPC ..... A47D 1/10; A47D 1/103; A47D 1/006; A47D 1/023; A47D 1/04; A47D 15/006

See application file for complete search history.

(56) References Cited

U.S. PATENT DOCUMENTS 5,421,636 A * 6/1995 Gamble ..... A47D 1/10 297/130

6,010,184 A * 1/2000 Lee ..... A47D 1/004 297/440.22

(Continued)

FOREIGN PATENT DOCUMENTS

EP 2540195 A1 6/2012

OTHER PUBLICATIONS

Antilop High chair tray, white/silver color—Ikea, Ikea, downloaded from Internet Dec. 11, 2023, 8 pages; https://link.edgepilot.com/s/aed637b9/cwJ2sykw_0_Sit2yqukkHA?u=https://www.ikea.com/us/en/p/antilop-high-chair-with-tray-white-silver-color-s89228434/.

(Continued)

*Primary Examiner* — Syed A Islam

(74) *Attorney, Agent, or Firm* — John L. DeAngelis; Wolter Van Dyke Davis, PLLC

(57) ABSTRACT

A high chair. A base structure rests on a support surface with upstanding structural members tapering inwardly and upwardly from a bottom region. A top structure has upstanding structural members tapering inwardly and upwardly from the bottom region. The top structure sets atop and in contact with the base structure. Alignment elements in the base and top structures ensure alignment when the structures are mated. A coupling mechanism couples the top base structures and can be removed to separate the top and base structures. The top structure includes a seat for the child. The top and base structures are dimensioned to allow the top structure to nest within a volume defined by the base structure.

14 Claims, 34 Drawing Sheets

(56) References Cited

U.S. PATENT DOCUMENTS

Figure 1:
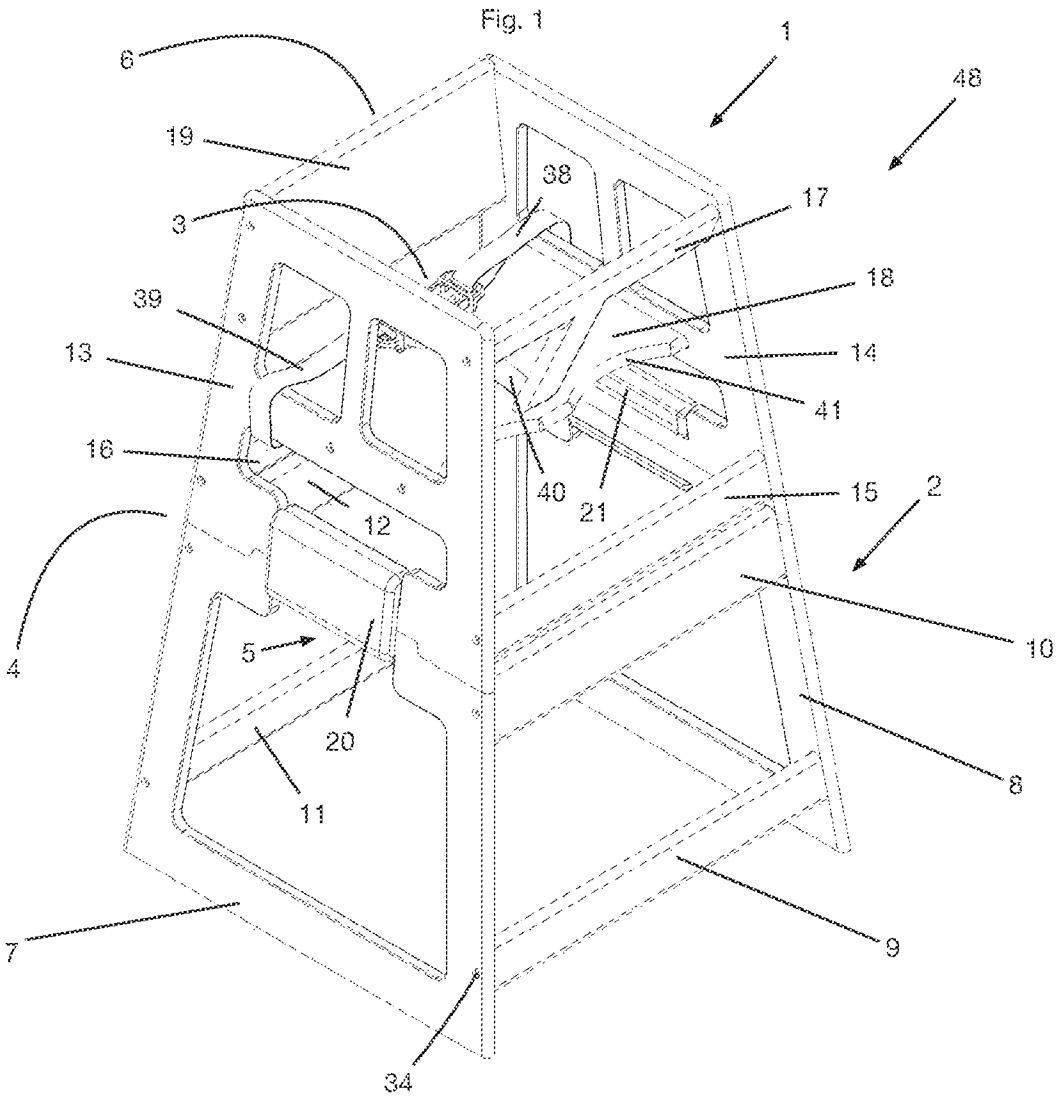

| | | | | |
|---|---|---|---|---|
| 8,727,435 | B2 * | 5/2014 | Centracco | A47D 1/10 2/49.3 |
| 9,788,662 | B1 * | 10/2017 | Hollett | A47D 1/006 |
| 10,492,621 | B2 * | 12/2019 | Ingraham | A47D 1/004 |
| 2001/0019219 | A1 * | 9/2001 | Helmsderfer | A47D 1/10 297/440.22 |
| 2011/0074186 | A1 * | 3/2011 | Zhong | A47D 1/103 297/130 |
| 2017/0258245 | A1 * | 9/2017 | Messer, Jr. | A47D 15/006 |
| 2020/0008586 | A1 | 1/2020 | Singh et al. | |
| 2021/0161307 | A1 * | 6/2021 | Dean | A47C 7/622 |

OTHER PUBLICATIONS

Koala Kare KidSitter Video, Webstaurant Store, downloaded from Internet Dec. 11, 2023, 4 pages; https://link.edgepilot.com/s/99d8a771/cjkxANh_m0i7XWFGUO8Z1Q?u=https://www.webstaurantstore.com/video-8498/koala-kare-kidsitter.html.

Landcaster Table & Seating Unassembled Standard Height Wooden High Chair, Webstaurant Store, downloaded from Internet Dec. 11, 2023, 17 pages; https://link.edgepilot.com/s/107e55f0/bQelh3RntkiwlVqmni3TqA?u=https://www.webstaurantstore.com/lancaster-table-seating-ready-to-assemble-restaurant-wood-high-chair-with-mahogany-finish/164HIGHCKDMO.html.

* cited by examiner

60

23
69
14
8
70

22
68
13
7
67

61

MULTI-PART DISHWASHER-OPTIMIZED HIGH CHAIR

CROSS REFERENCE TO RELATED APPLICATIONS

The present application claims the benefit under 35 U.S.C. 119(e) of the provisional patent application filed on Apr. 17, 2022 and assigned application No. 63/331,857. The entire contents of this application are incorporated herein.

FIELD OF THE INVENTION

The subject invention relates generally to the cleaning of high chairs and to high chairs that can be regularly, consistently, and thoroughly cleaned according to a reliable and standardized cleaning regimen, and more specifically to techniques and methods by which such tasks can be completed, and to a high chair designed to facilitate a thorough cleaning process.

BACKGROUND OF THE INVENTION

While conducting research in a variety of fields, the team of inventors uncovered an unmet need in consistently, reliably, and regularly cleaning high chairs in food establishment settings. There lacks a universal means of establishing and maintaining the cleanliness of high chairs in such food establishments (e.g., restaurants, diners, hotels).

In food establishments currently, there are many ways to clean surfaces, furniture, and high chairs. The methods and materials for cleaning the high chairs vary widely, however, from establishment to establishment. Further, management styles, establishment organization, and employee workflows differ significantly from establishment to establishment. This not only results in unclean high chairs, with germ-laden food scraps, but also causes damage to the chairs and an inefficient use of employee time. The damage to the chairs results in shortened product life cycles and unpleasant customer experiences.

But this lack of hygiene is not present in all aspects of food establishments. Plates, silverware, cooking utensils, and other equipment is routinely and effectively cleaned to ensure sanitary eating conditions and customer safety. This standard cleanliness derives from a rigorous cleaning standard coupled with the high effectiveness of commercial dishwashers.

Furniture in food establishments is often too large or made of inadequate materials to be effectively cleaned in the dishwasher. Some furniture, such as tables and flat surfaces, have simple and established cleaning protocols that do not exist for seating furniture, including high chairs. While this is acceptable for most seating furniture, infants, babies, and toddlers for which the high chair is intended, have the tendency to create much more significant messes and erratic distribution of food debris.

Through testing of existing high chairs, the inventors have determined that cleaning high chairs by hand did not consistently result in an effective clean within a reasonable time frame. The geometry of high chairs creates areas that are difficult to reach and thus prohibits effective cleaning by hand. Over time, this feature of high chairs in combination with the inconsistencies associated with hand-cleaning, and established high chair cleaning practices, leaves food to accumulate and harden on the high chair, making the chair increasingly difficult to clean with each use.

SUMMARY OF THE INVENTION

Given these difficulties associated with high chair cleaning, the inventors have recognized an opportunity to leverage consistent and effective cleaning and sanitizing abilities of the commercial dishwasher, as well as its established place within food establishment operations, as a viable means to standardize high chair cleanliness and reduce the operational impact of cleaning high chairs in food establishments that rely on the use of high chairs to serve their customers.

The primary object of the invention is to provide a multi-part high chair structure that, when in a first assembled state, functions as a high chair, and when in a second disassembled state, comprises a plurality of pieces, further comprising seat and base components, such that each can be placed in an automated sanitation unit, including, but not limited to, a commercial dishwasher, for cleaning.

Another object of the invention is, in a third state, for the structure that creates the seat region to function as a booster seat with and without other associated structural components.

Another object of the invention is to provide techniques and components for relatively quickly coupling and decoupling the seat and the base such that restaurant employees can reasonably perform these cleaning actions between each use of the product.

Another object of the invention is to reduce the operational impact of cleaning high chairs on food establishments and its employees.

Another object of the invention is to provide a structure that when assembled to serve as a high chair, is compatible with the standard operations and furniture and equipment arrangement of the food establishment.

Another object of the invention is to provide a coupling and decoupling alignment mechanism between the various pieces such that when in the first state as a high chair, the child cannot, under its own volition, decouple the high chair while seated.

Another object of the invention is to provide an active restraint system that is easy to attach for securing the child in place.

Another object of the invention is to provide an active restraint system that prevents the accumulation of food and liquid matter over time and can withstand repeated cycles of cleaning and dishwashing.

Another object of the invention is to provide a means of alignment between the seat of the high chair and the bottom of the high chair such that the connection orientation and mating is consistently accurate.

Another object of the invention is to provide the capability for at least three high chairs to stack vertically, one atop another, balanced to reduce the chance of the stack collapsing, in order to minimize floor space needed for storage of the high chairs.

Another object of the invention is to provide the capability for all parts designed to nest within each other such that they can all simultaneously fit in a commercial sanitation unit (e.g., a dishwasher) when disassembled.

BRIEF DESCRIPTION OF THE INVENTION

The present invention can be more easily understood and the advantages and uses thereof more readily apparent when the detailed description of the present invention is read in conjunction with the figures wherein:

FIG. 1: Perspective view of high chair in its primary use state.

Figure 2:
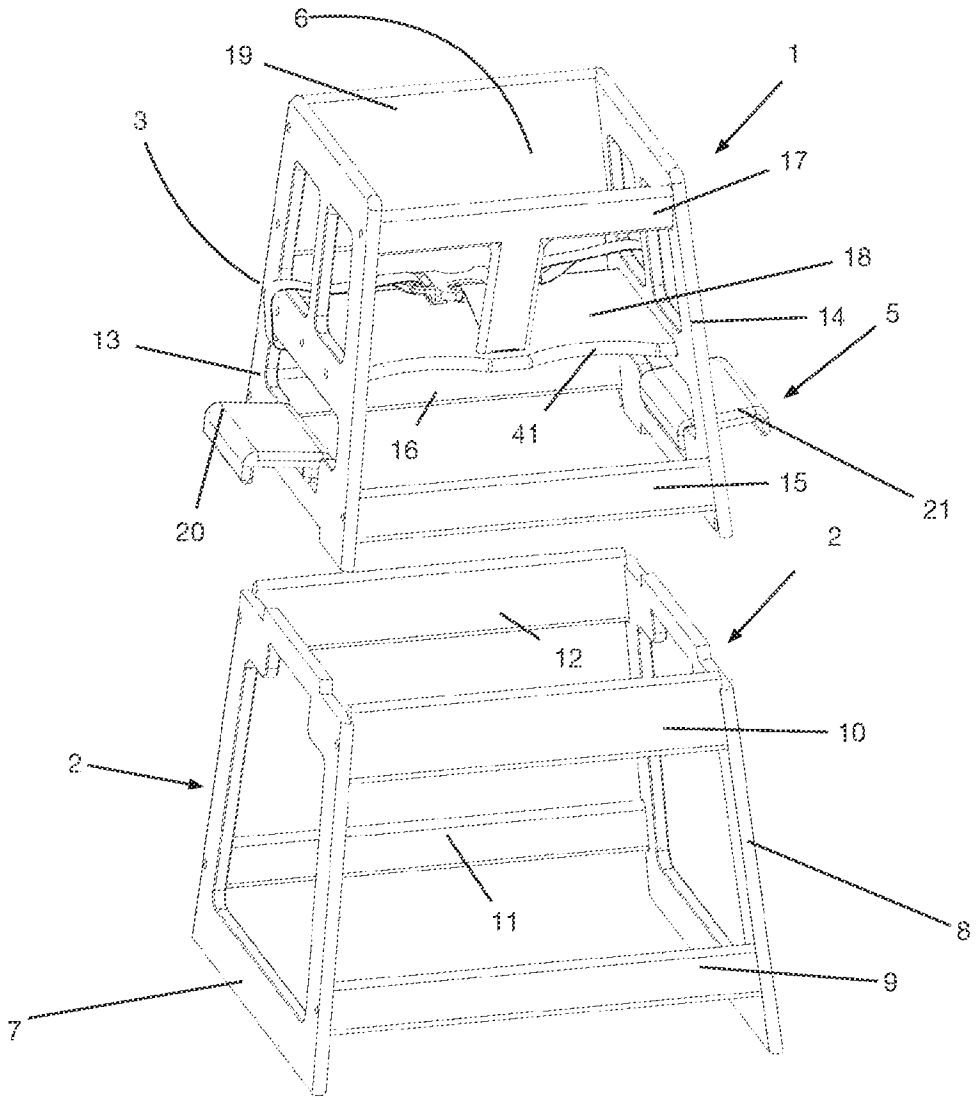

FIG. 2: Perspective view of the high chair separated into subassemblies in preparation for a secondary use state.

Figure 3:
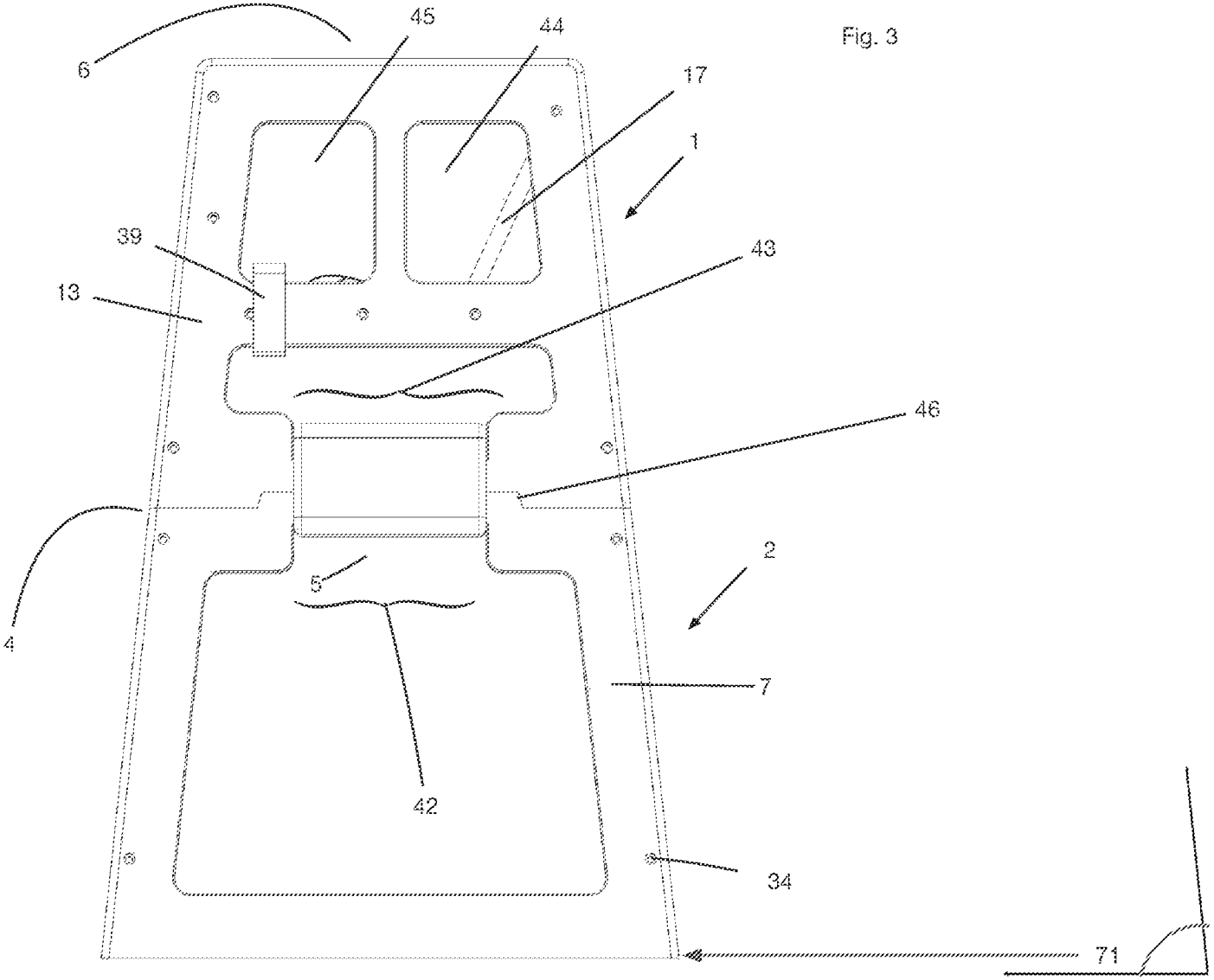

FIG. 3: Side view of high chair in primary use state.

Figure 4:
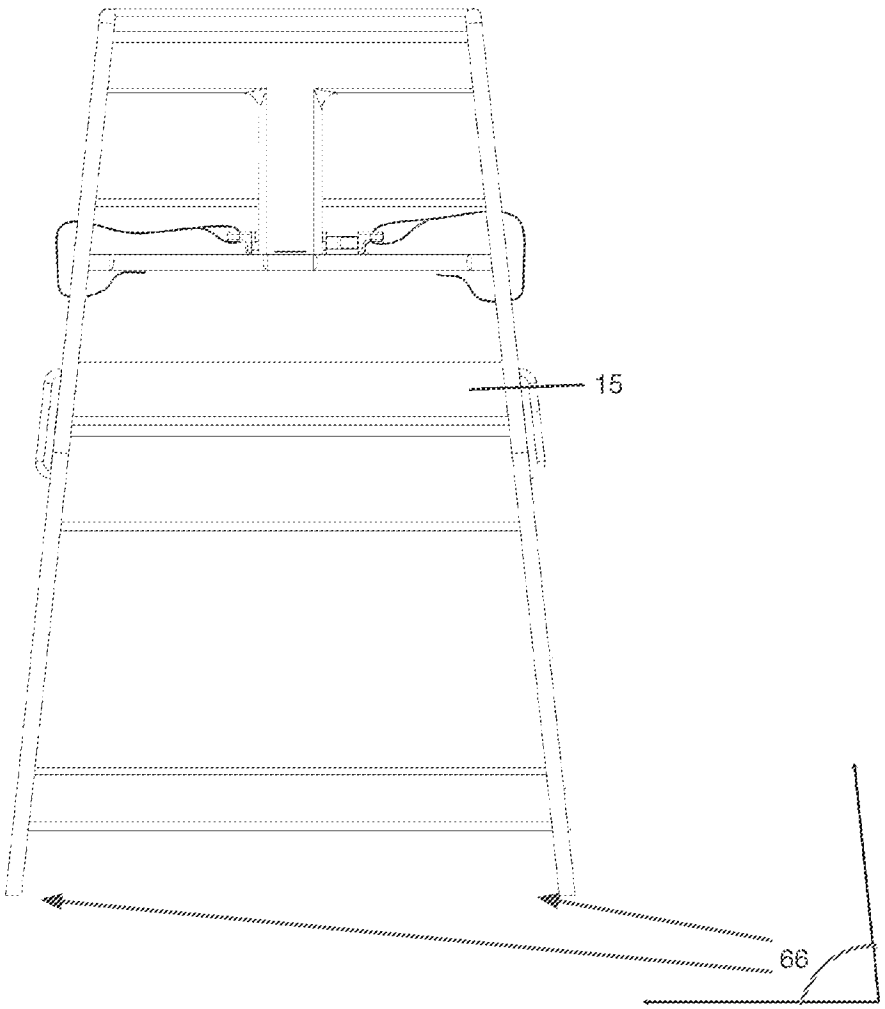

FIG. 4: Front view of high chair in primary use state.

Figure 5:
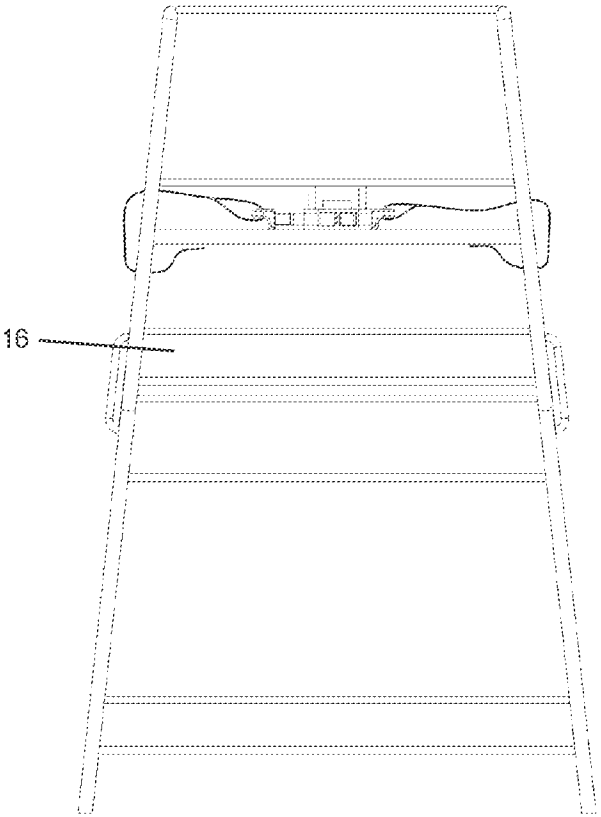

FIG. 5: Rear view of high chair in primary use state.

Figure 6:
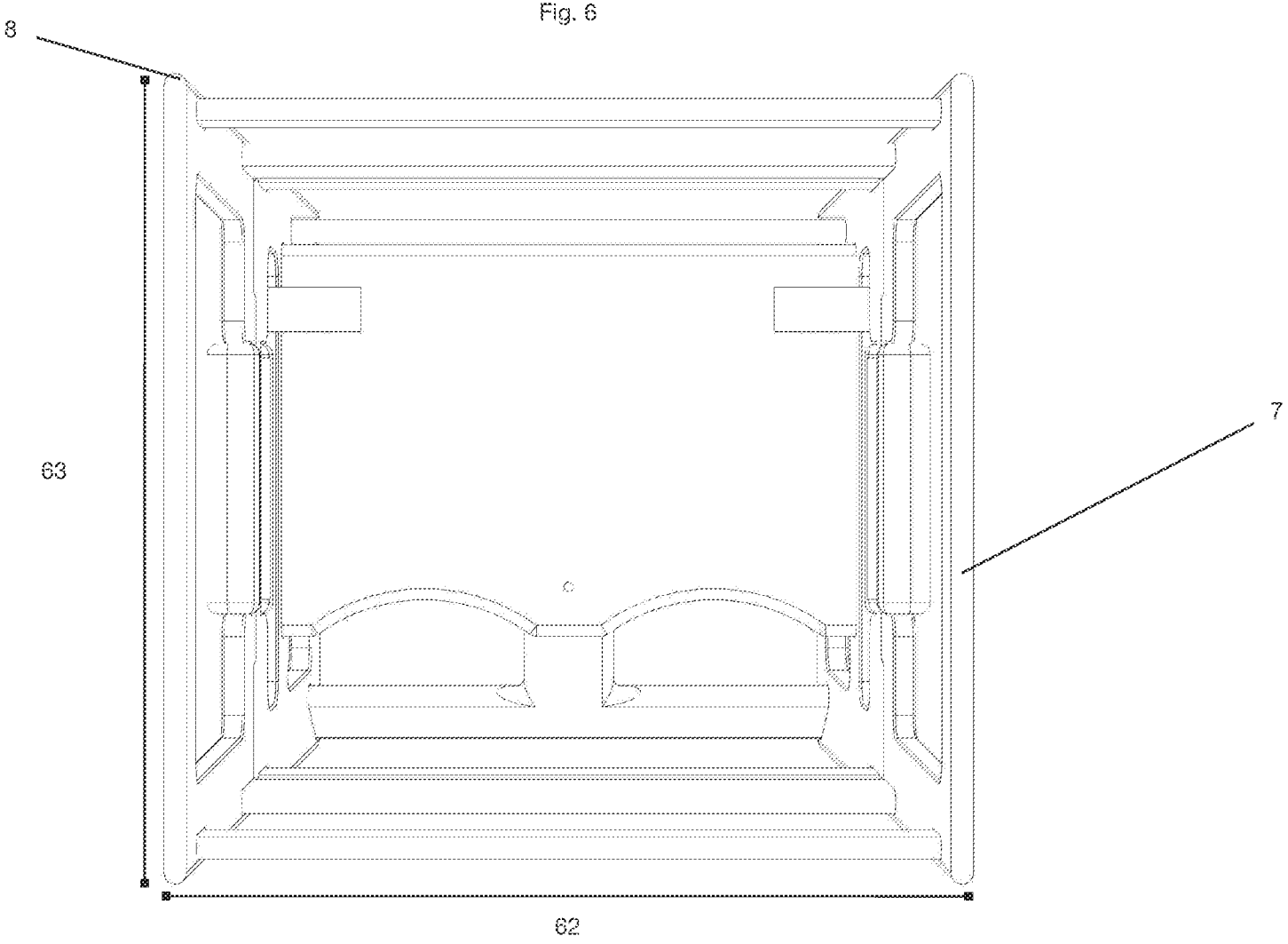

FIG. 6: Bottom view of high chair in primary use state.

Figure 7:
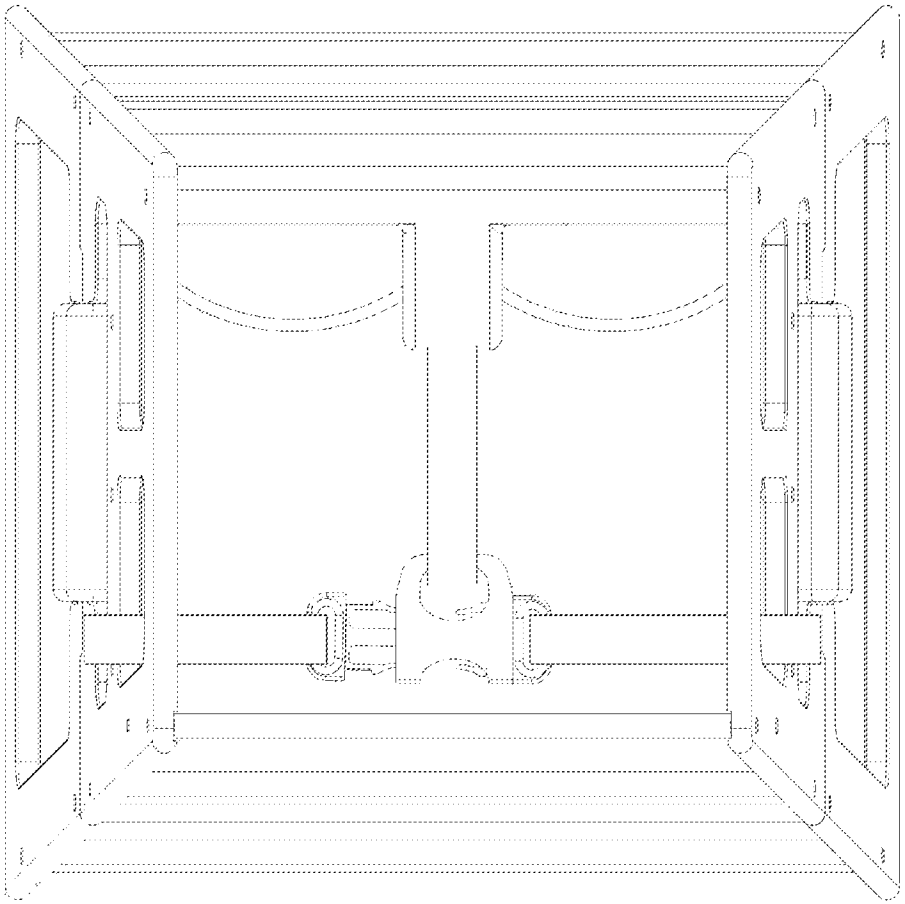

FIG. 7: Bottom view of high chair in primary use state.

Figure 8:
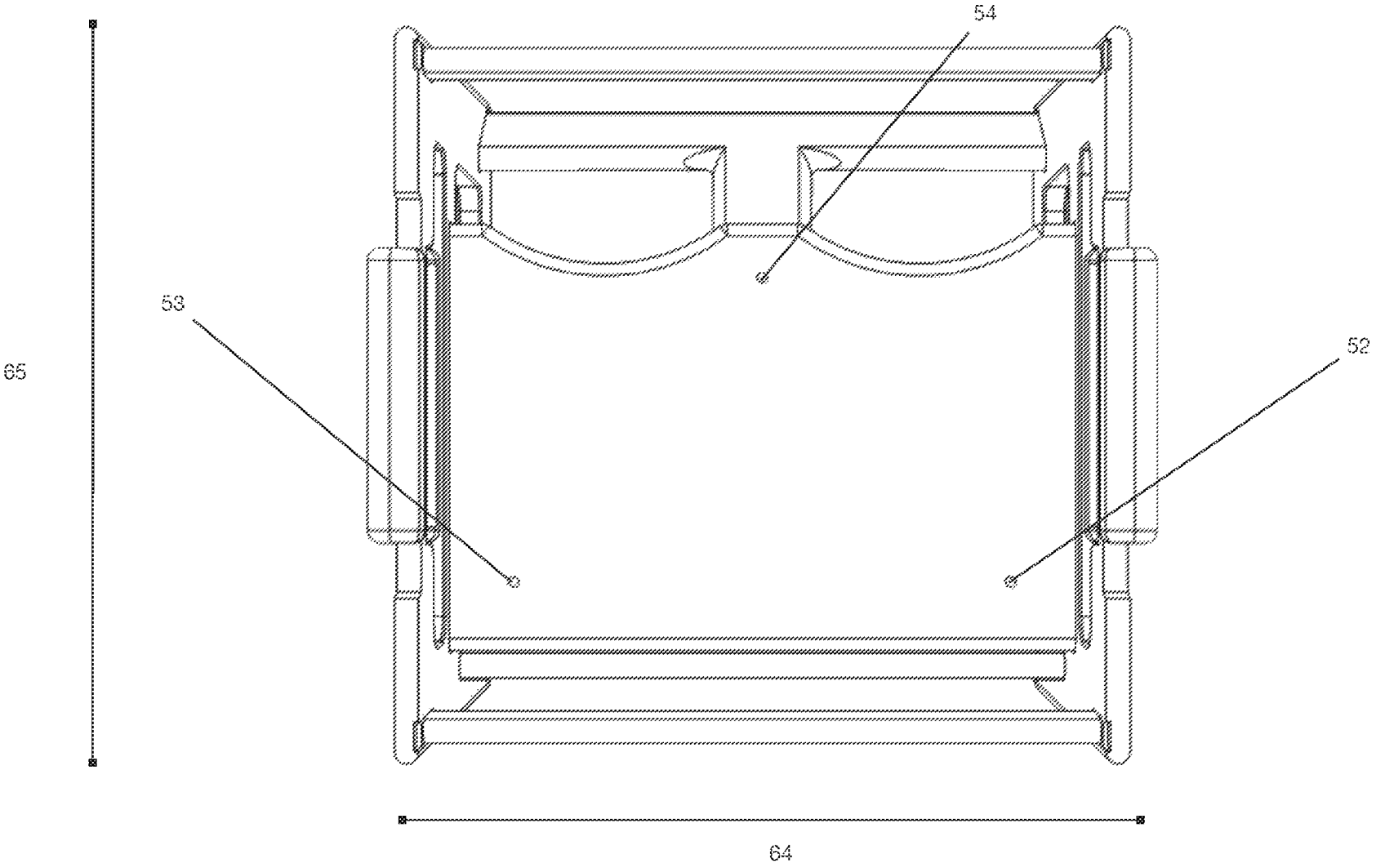

FIG. 8: Bottom view of top subassembly.

Figure 9:
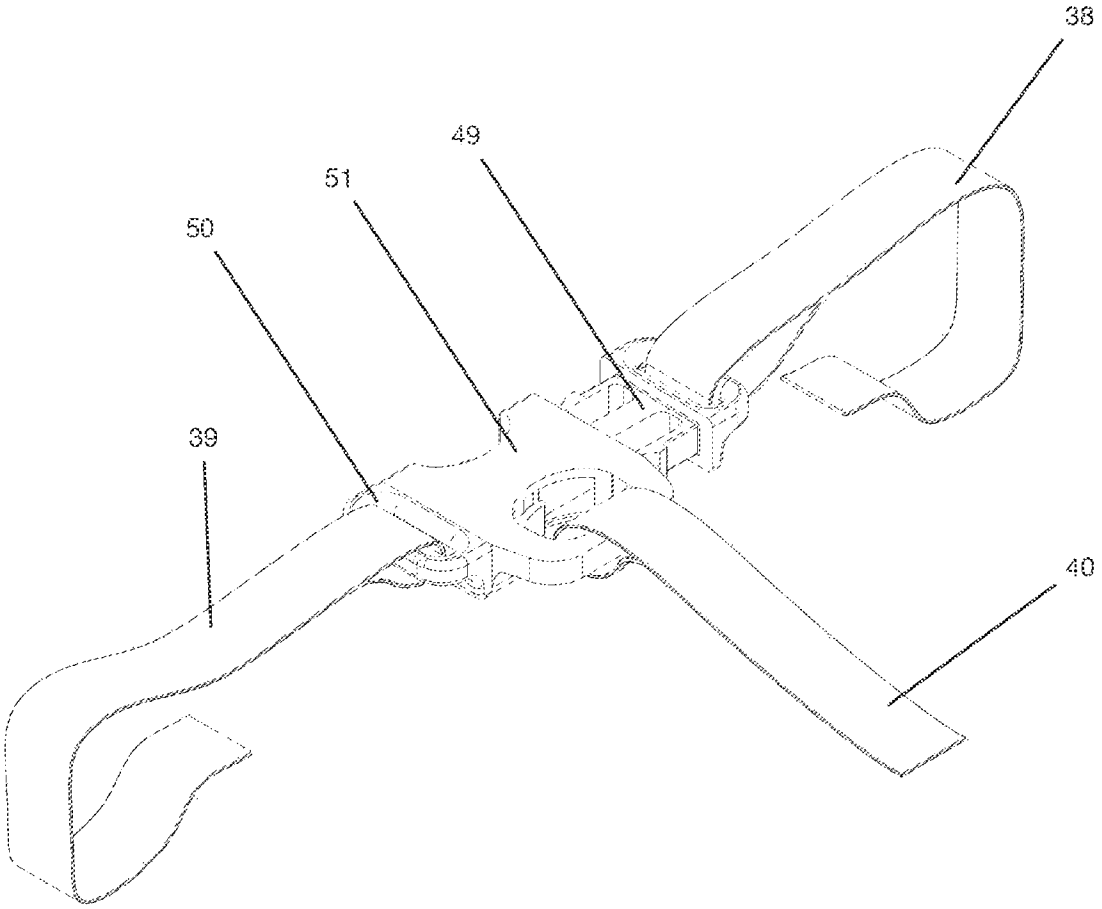

FIG. 9: Isolated view of active restraint.

Figure 10:
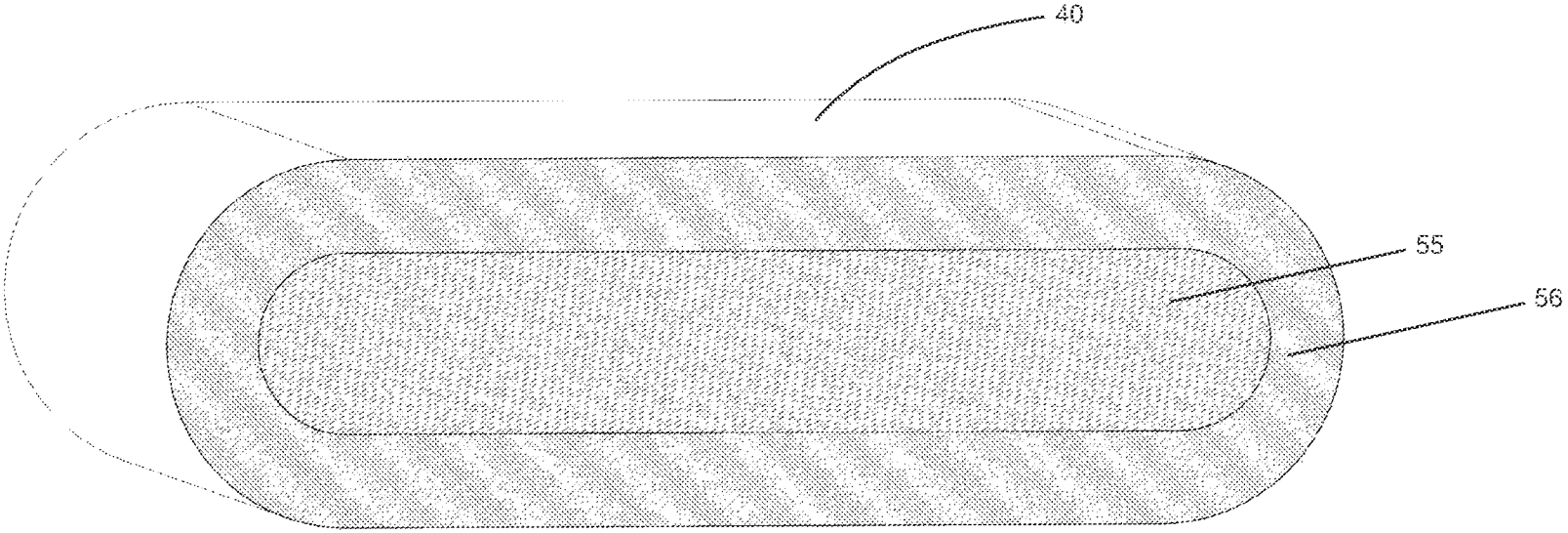

FIG. 10: Section view of restraint strap construction.

Figure 11:
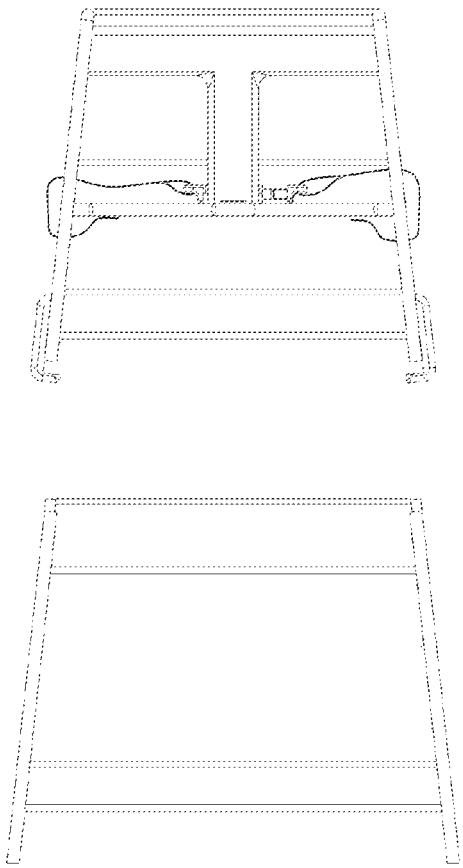

FIG. 11: Exploded front view of high chair separated into subassemblies in preparation for a secondary use state.

Figure 12:
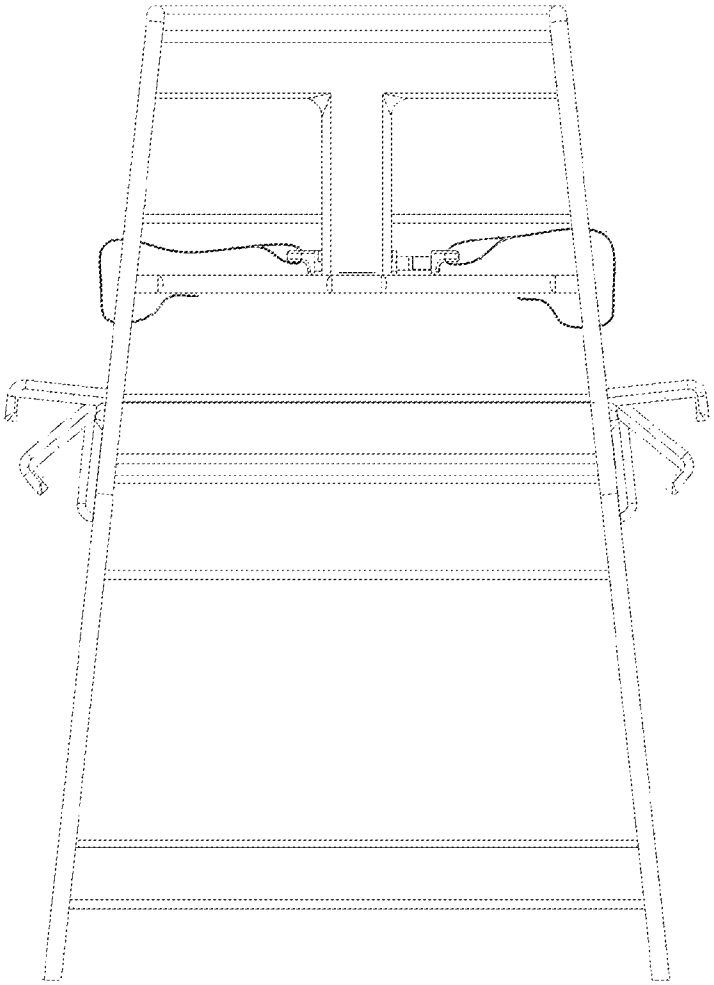

FIG. 12: Front view of high chair showing locking mechanism.

Figure 13:
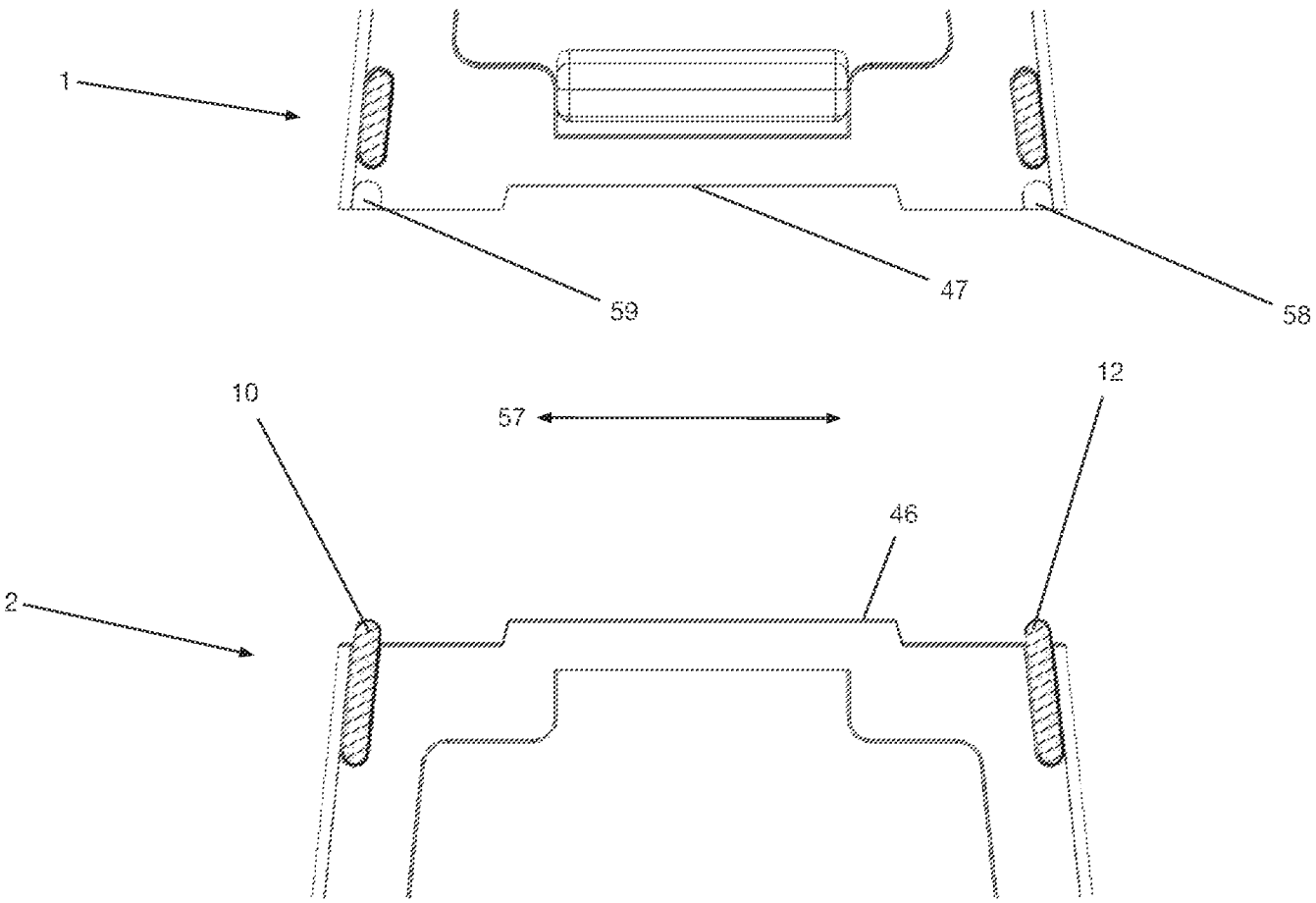

FIG. 13: Exploded side section view of alignment mechanism.

Figure 14B:
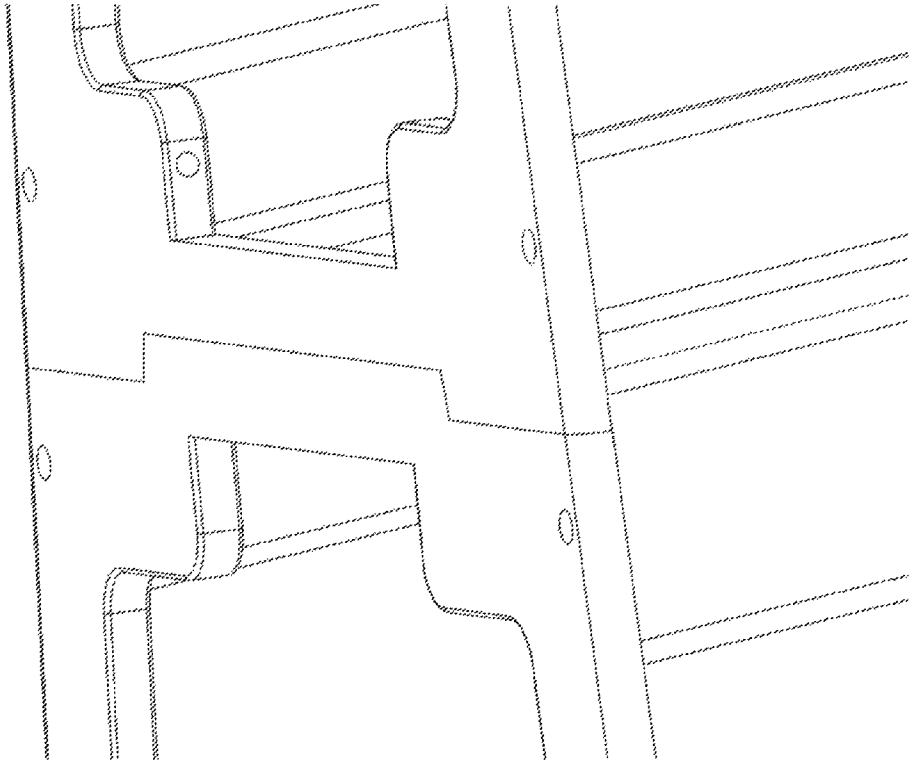
Figure 14A:
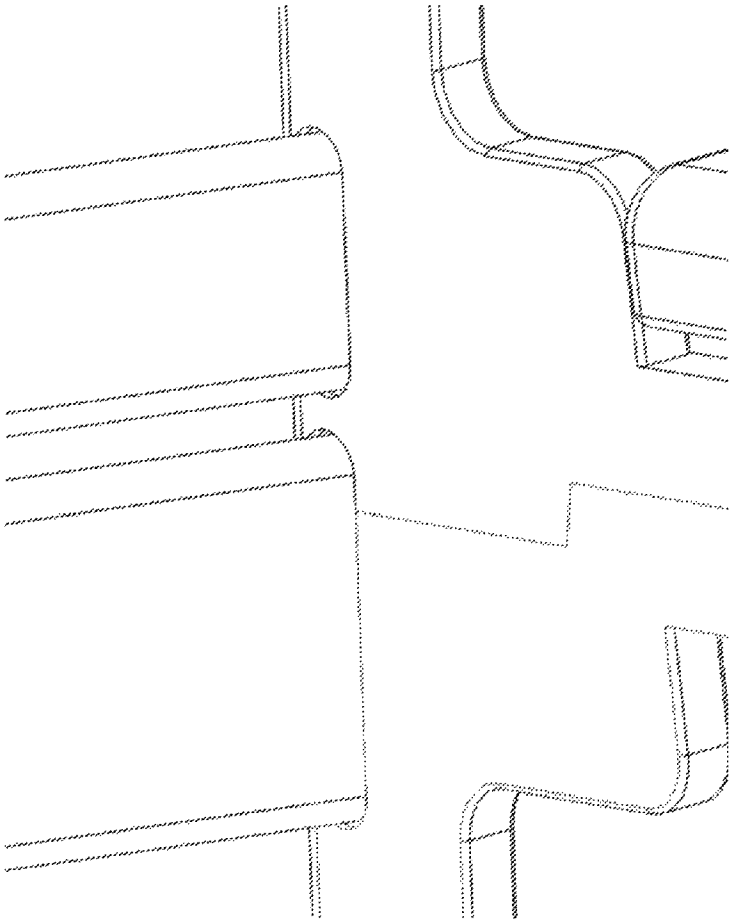

FIGS. 14A and 14B: Close-up view of shapes part of an alignment mechanism.

Figure 15:
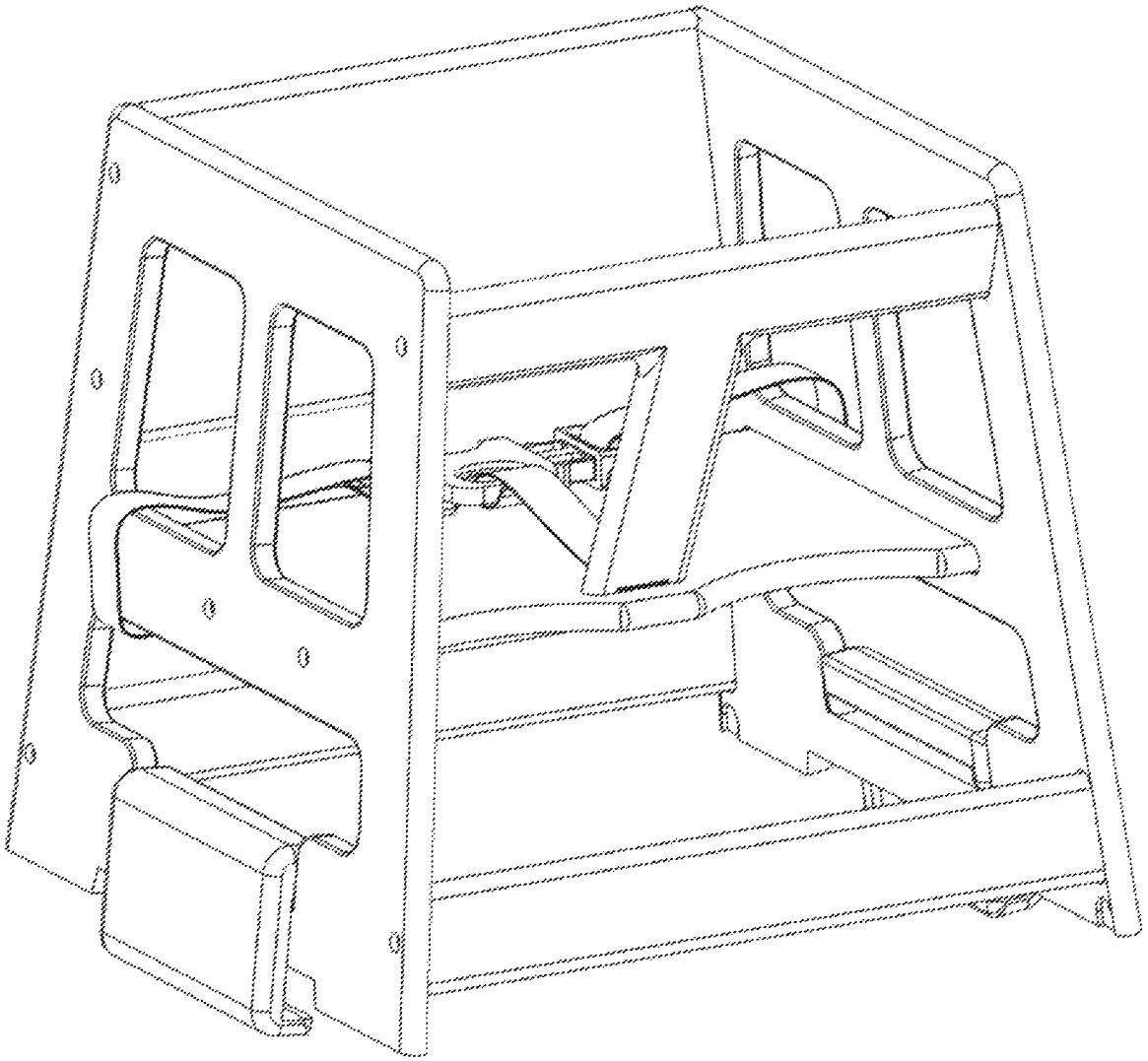

FIG. 15: Perspective view of top subassembly

Figures 16A, 16B, 16C:
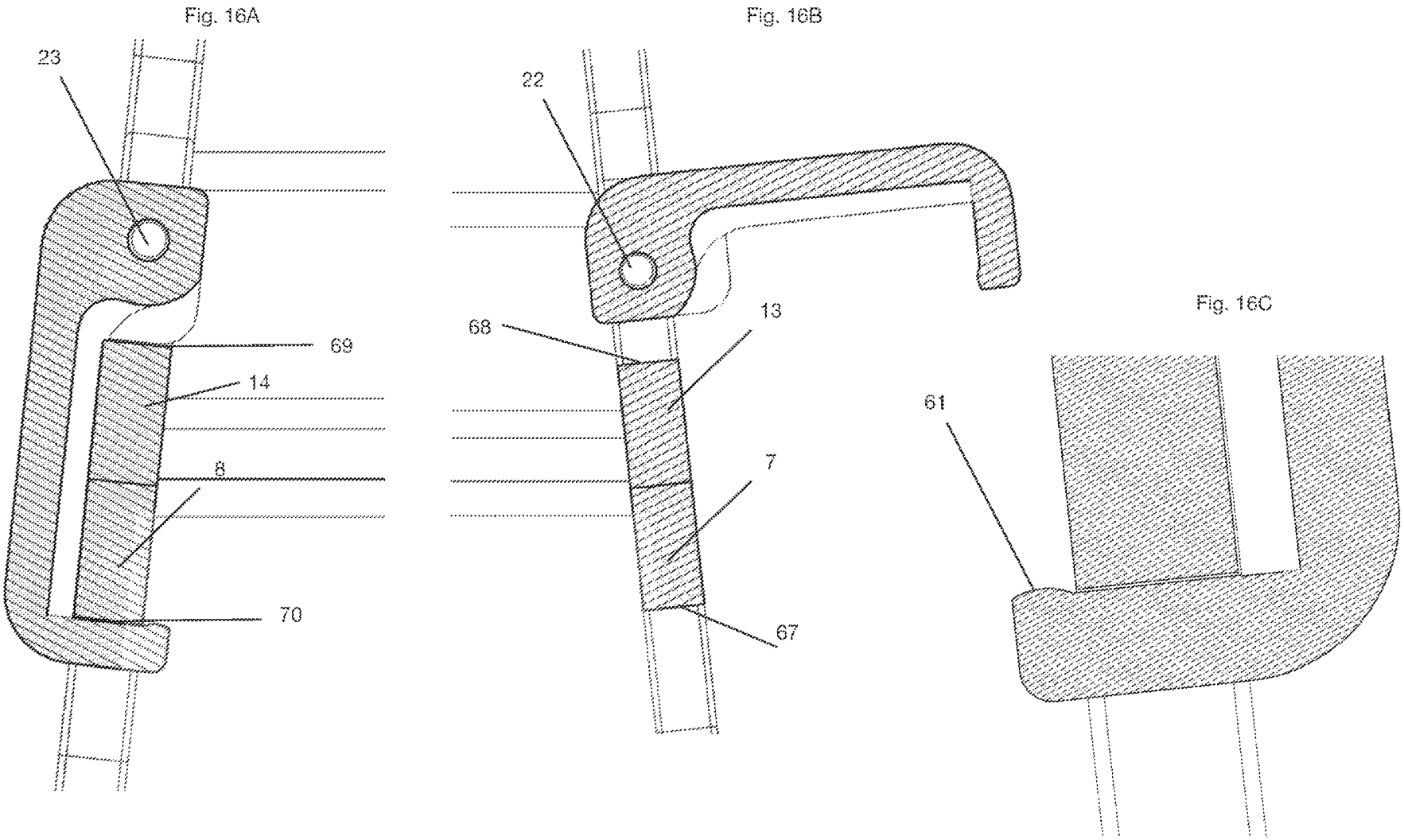

FIGS. 16A, 16B, and 16C: Section views of locking mechanism in various states.

Figure 17:
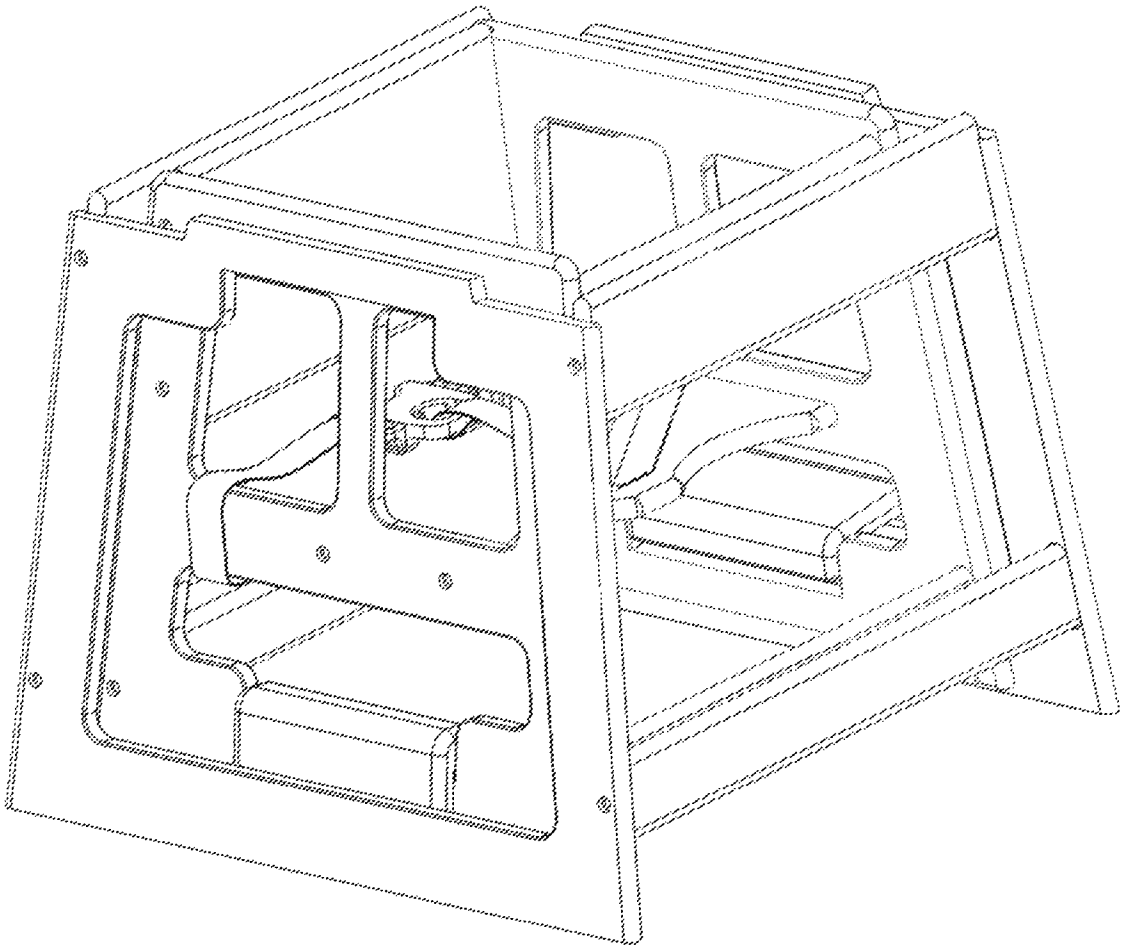

FIG. 17: View of nested subassemblies.

Figure 18:
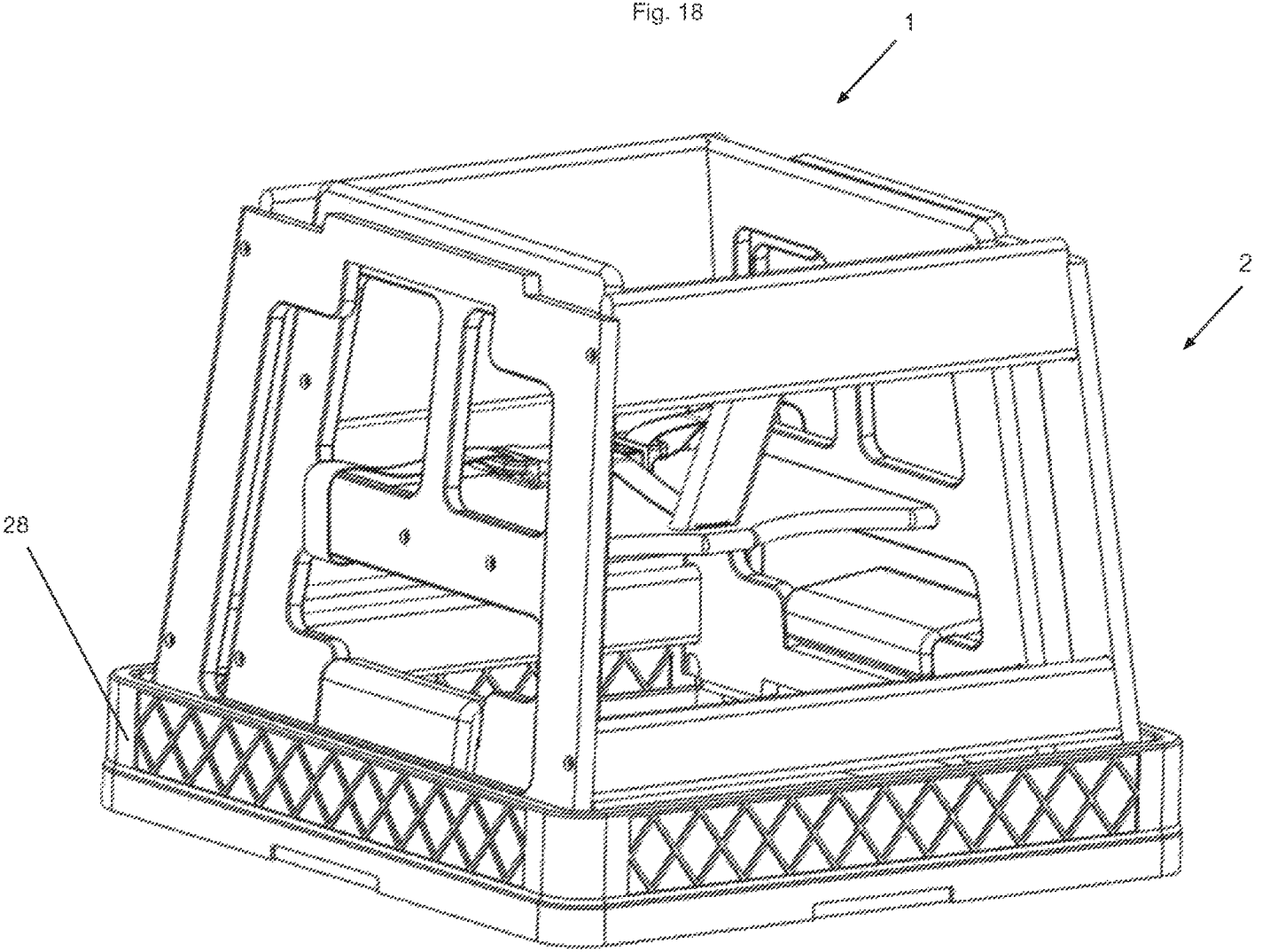

FIG. 18: View of nested subassemblies within standard dishwashing tray.

Figure 19:
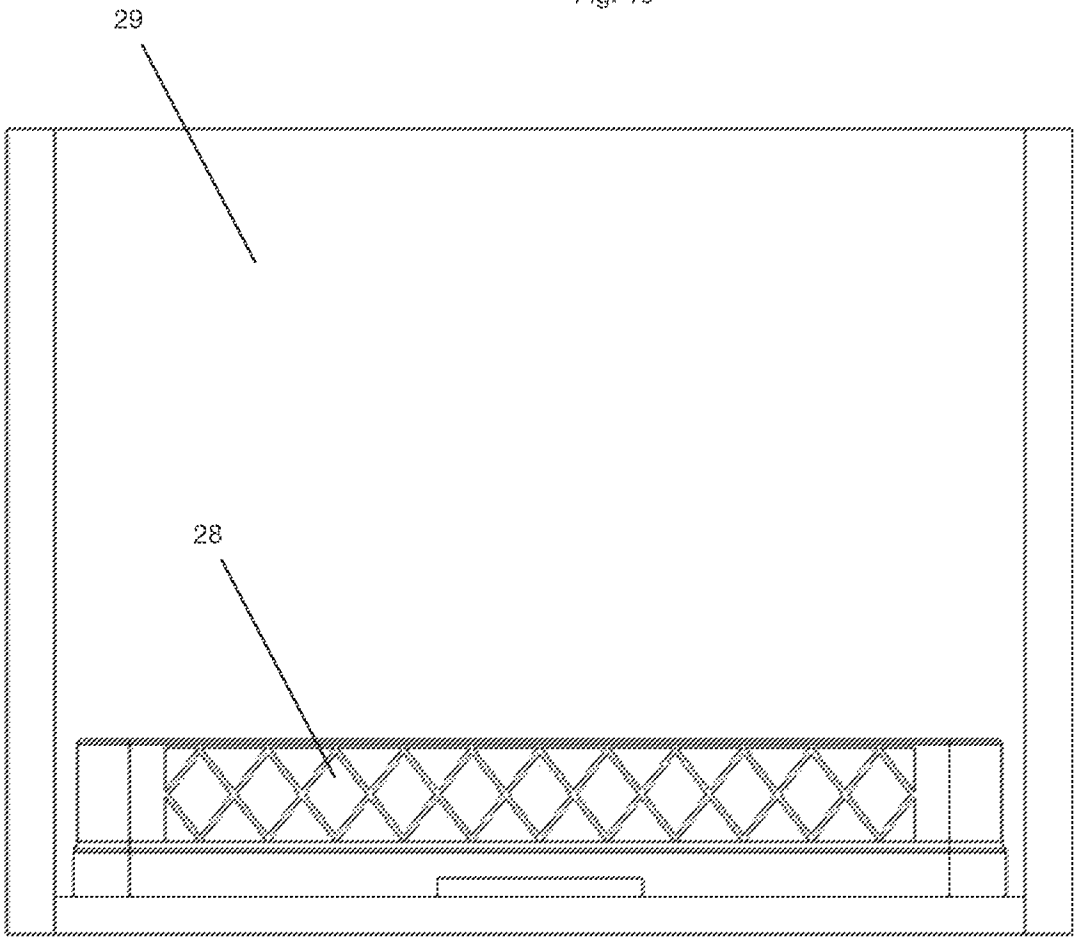

FIG. 19: Front view of dishwasher tray and clearance boundary.

Figure 20:
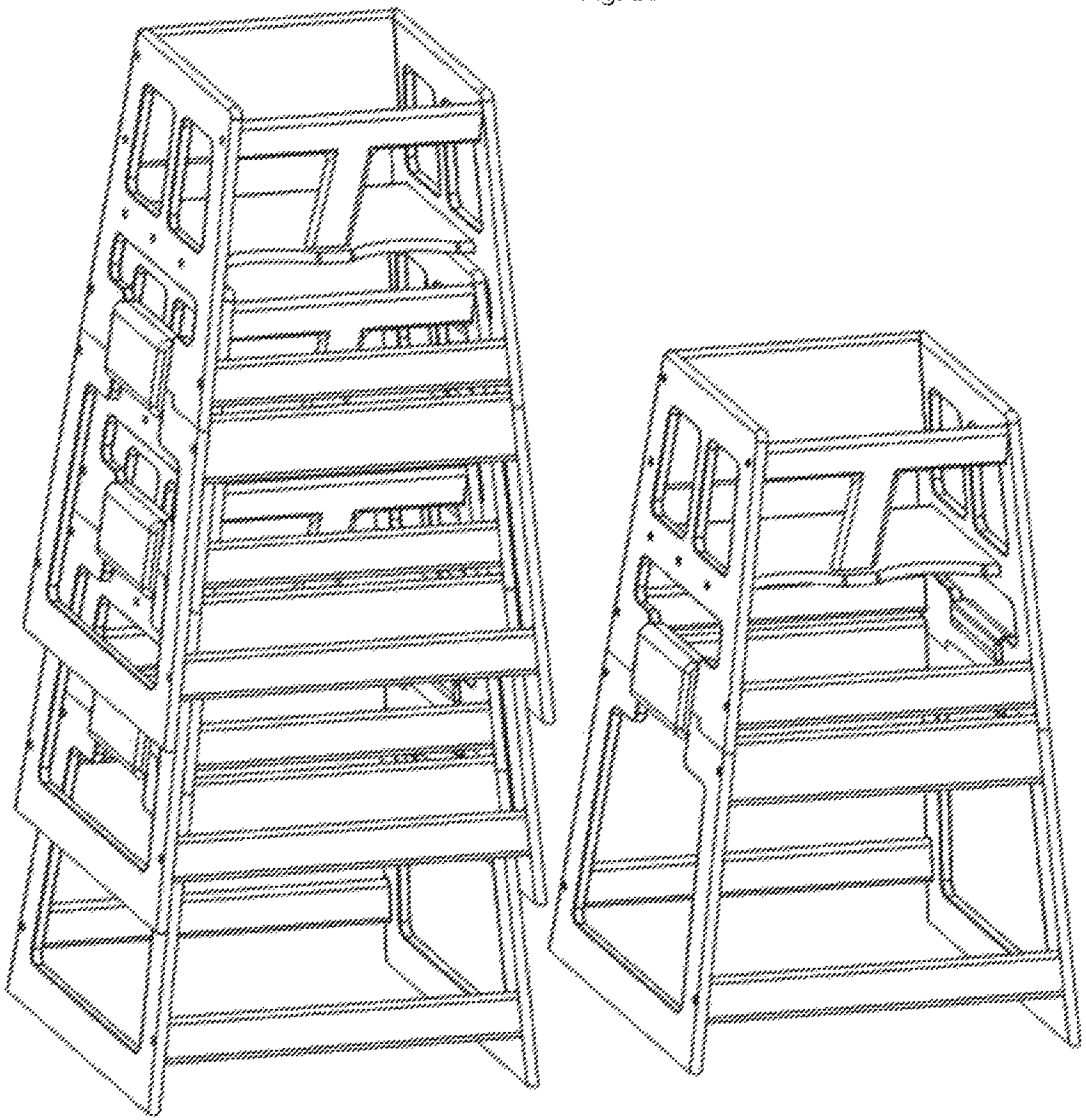

FIG. 20: Typical stacking functionality of multiple high chairs.

Figure 21:
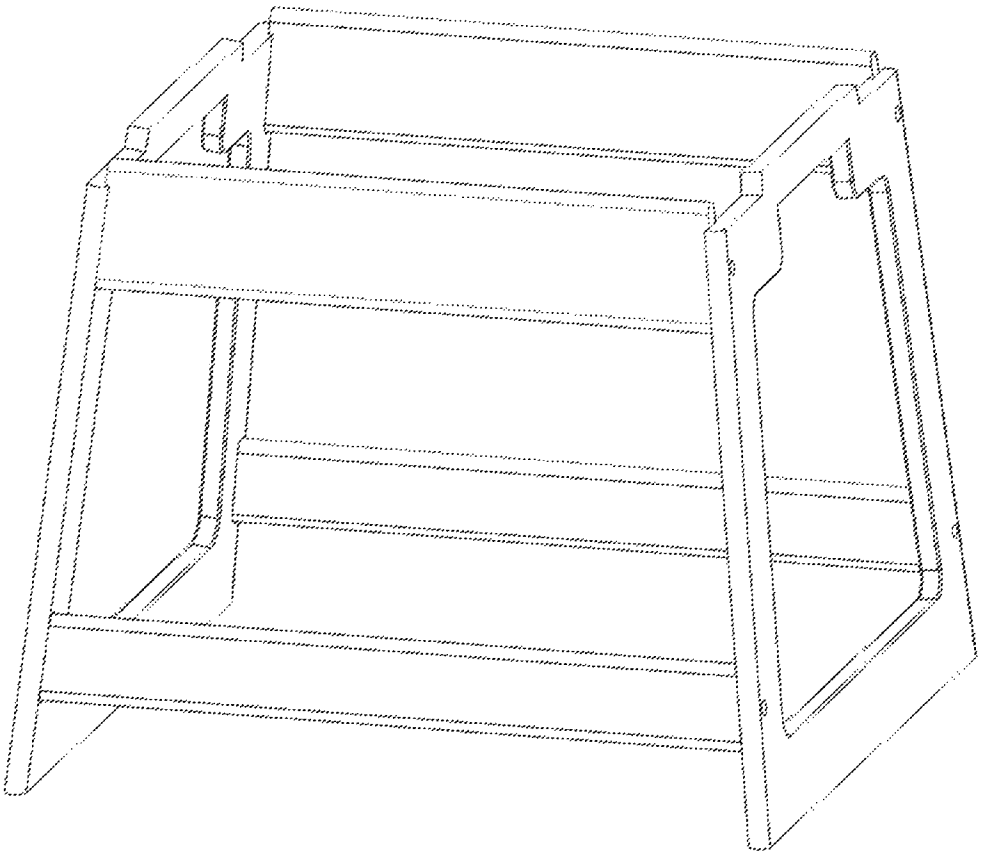

FIG. 21: Perspective view of bottom subassembly.

Figure 22:
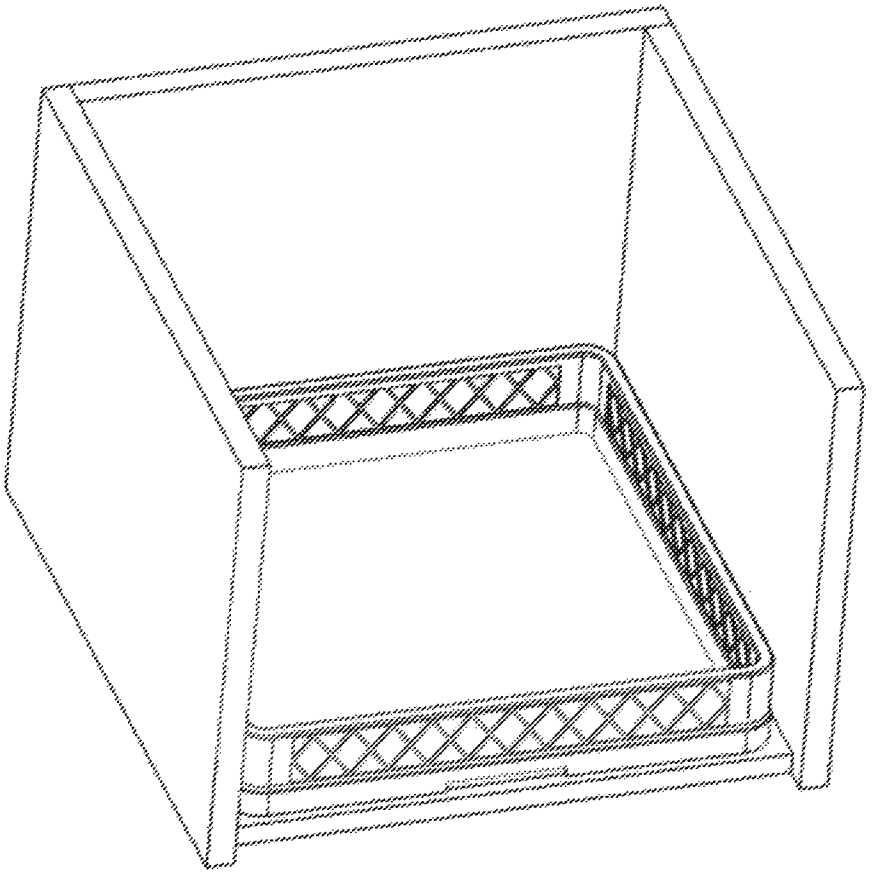

FIG. 22: Perspective view of typical dishwasher boundary with typical dishwashing tray.

Figure 23:
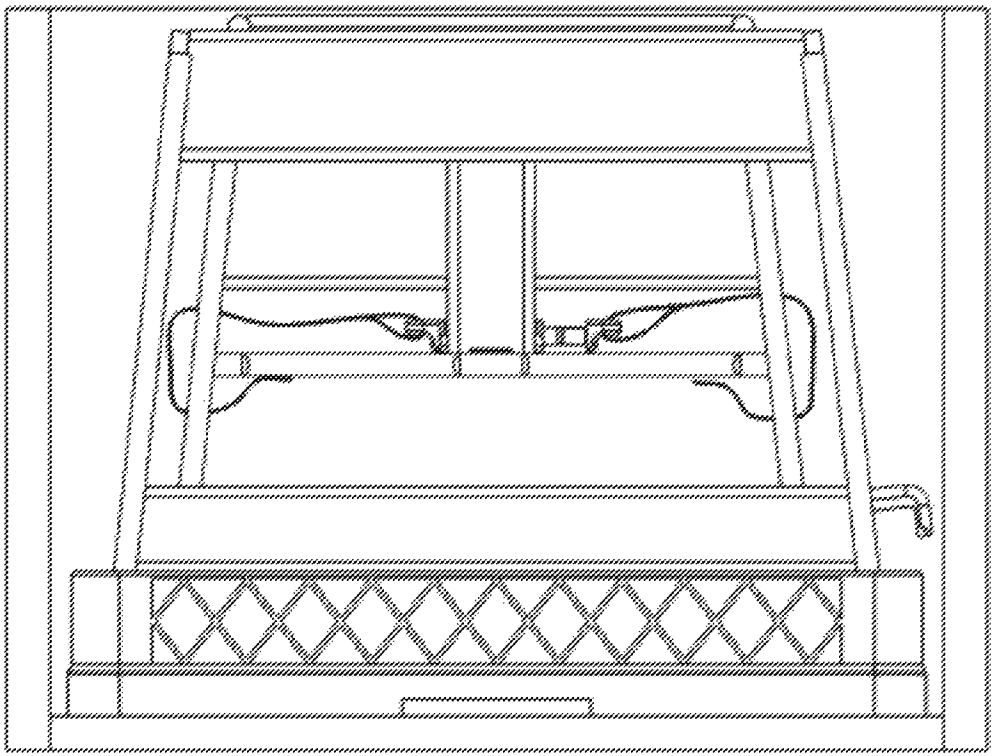

FIG. 23: Front view of high chair in its secondary use state in a dishwasher. tray within typical commercial dishwasher boundaries.

Figure 24:
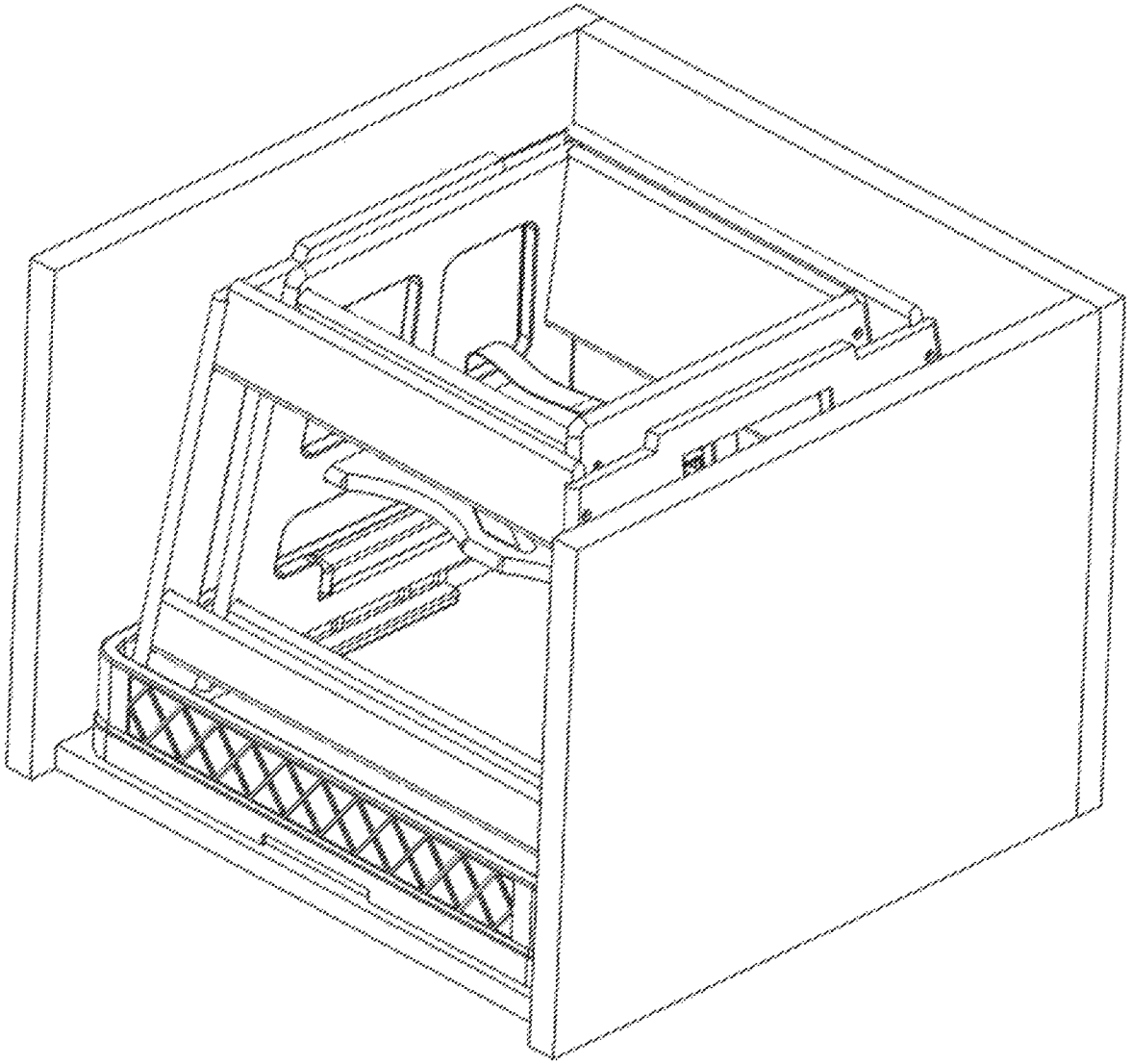

FIG. 24: Perspective view of high chair in its secondary use state in a dishwasher tray within typical commercial dishwasher boundaries.

Figure 25:
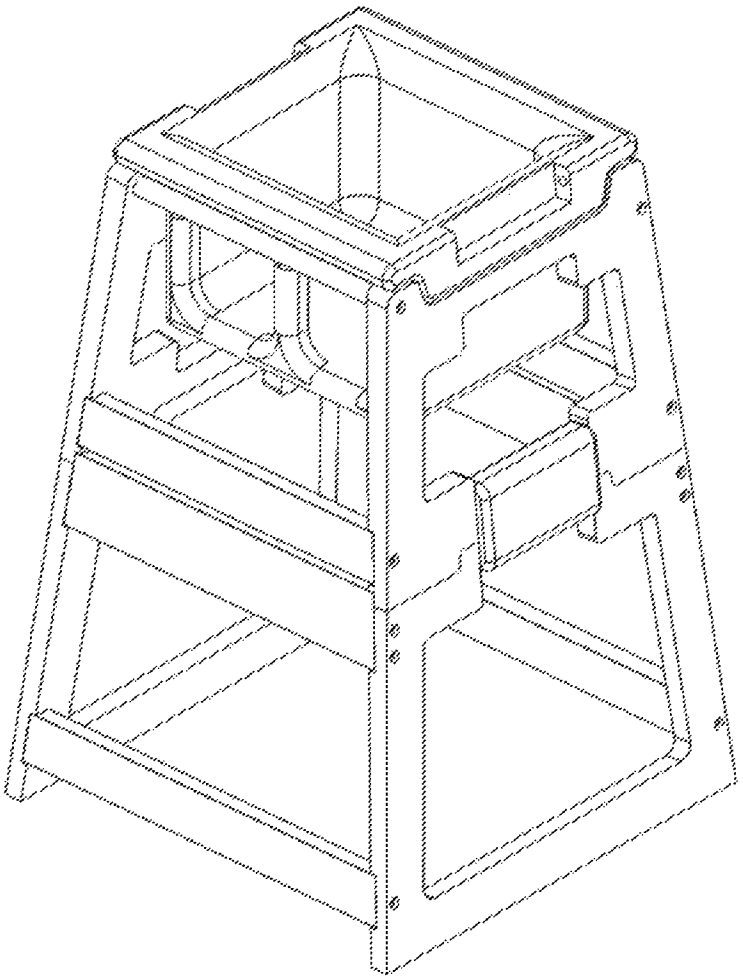

FIG. 25: An alternative embodiment with a third subassembly.

Figure 26:
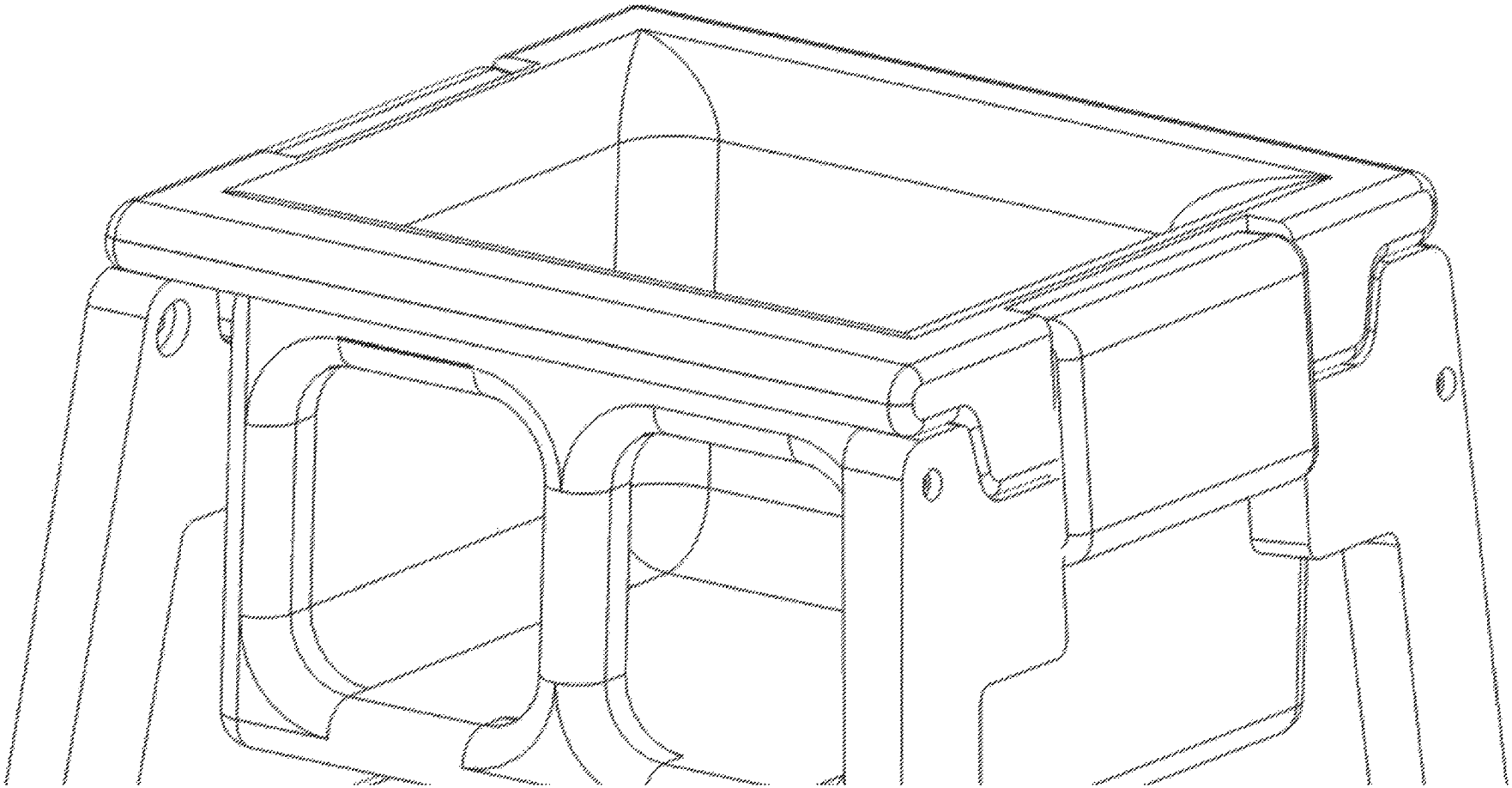

FIG. 26: Seating area and locking mechanism of an alternative embodiment.

Figure 27:
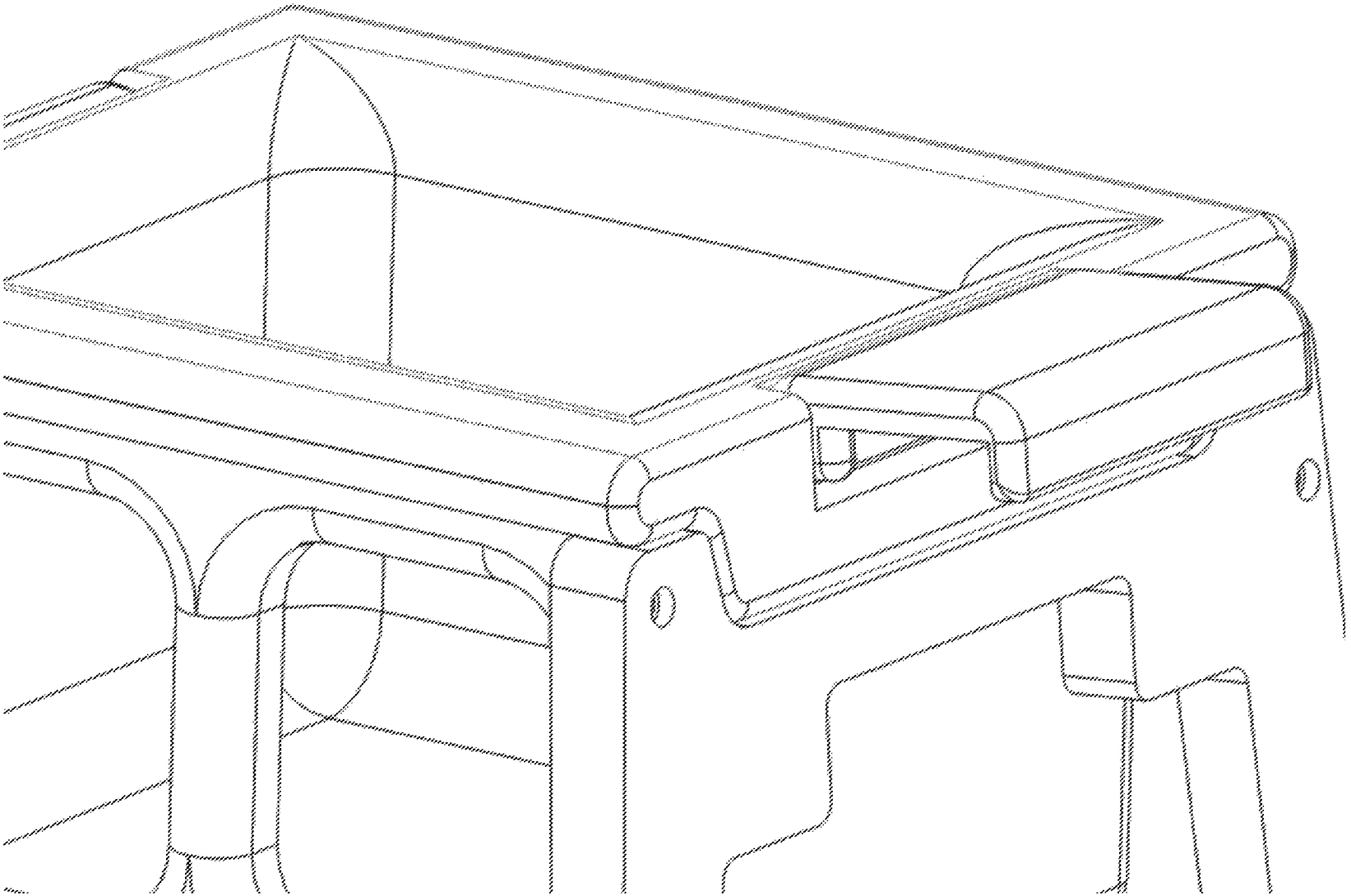

FIG. 27: Partially disengaged locking mechanism on an alternative embodiment.

Figure 28:
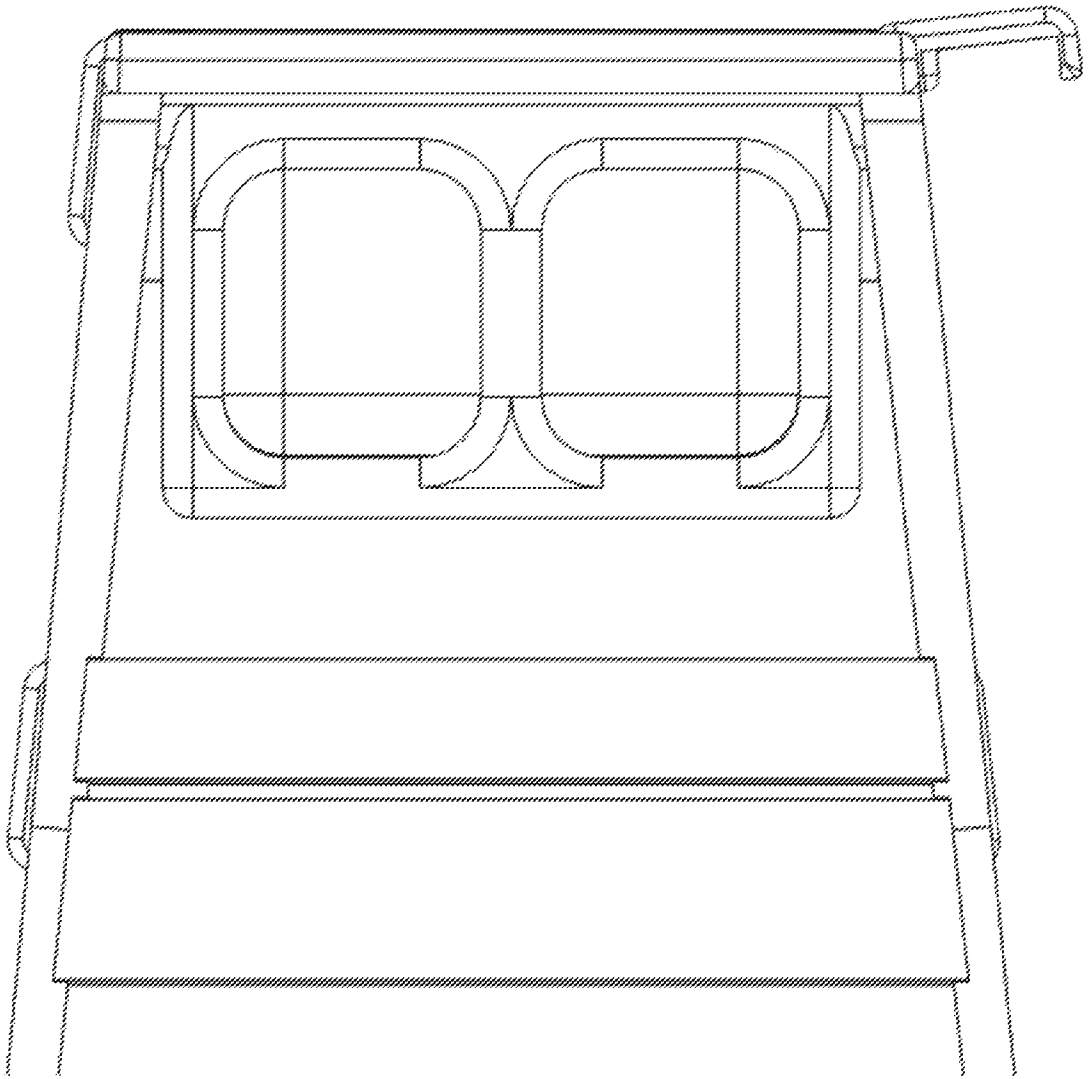

FIG. 28: Front view of partially disengaged locking mechanism on an alternative embodiment.

Figure 29:
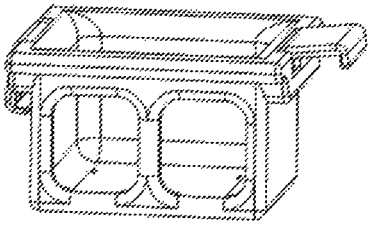
Figure 29:
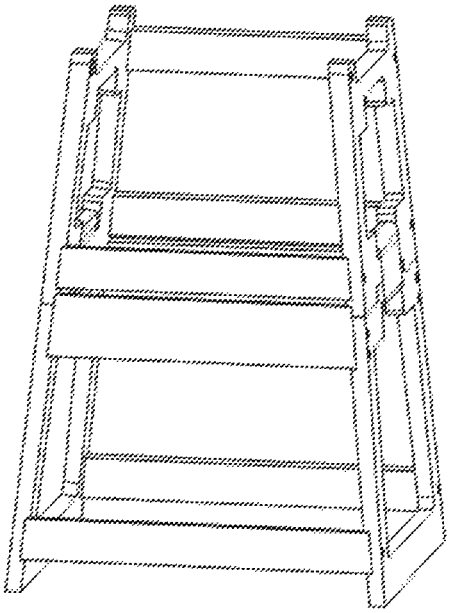

FIG. 29: Exploded perspective view of an alternative embodiment with top subassembly detached FIG. 30: Exploded perspective view of an alternative embodiment with all subassemblies.

Figure 31:
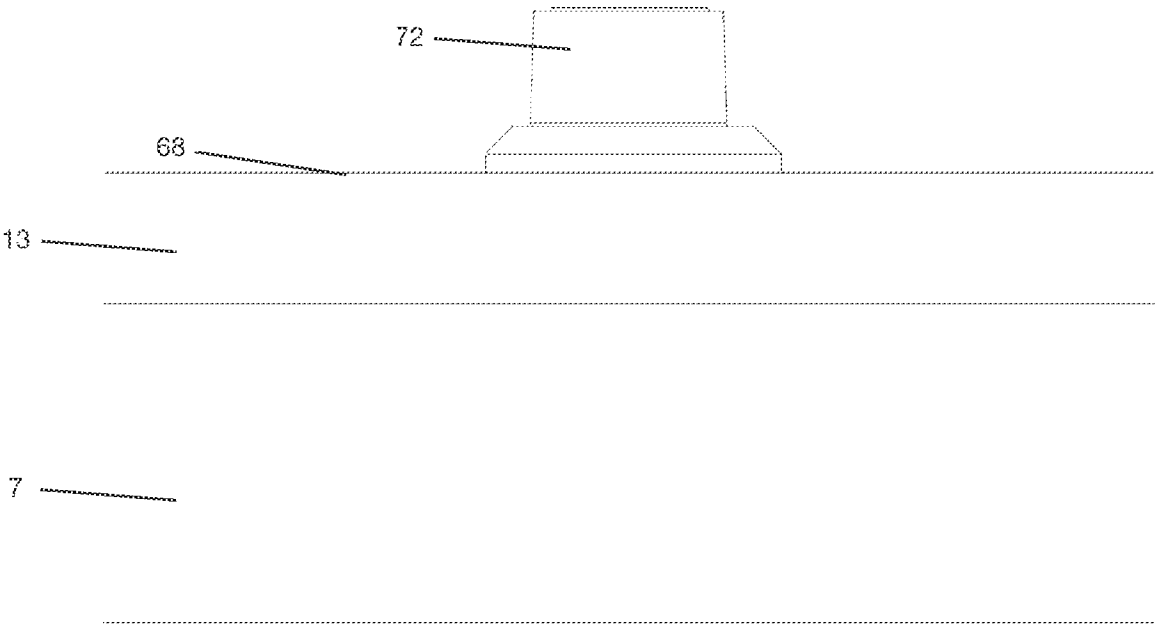

FIG. 31: Front view of alternative locking mechanism in locked state.

Figure 32:
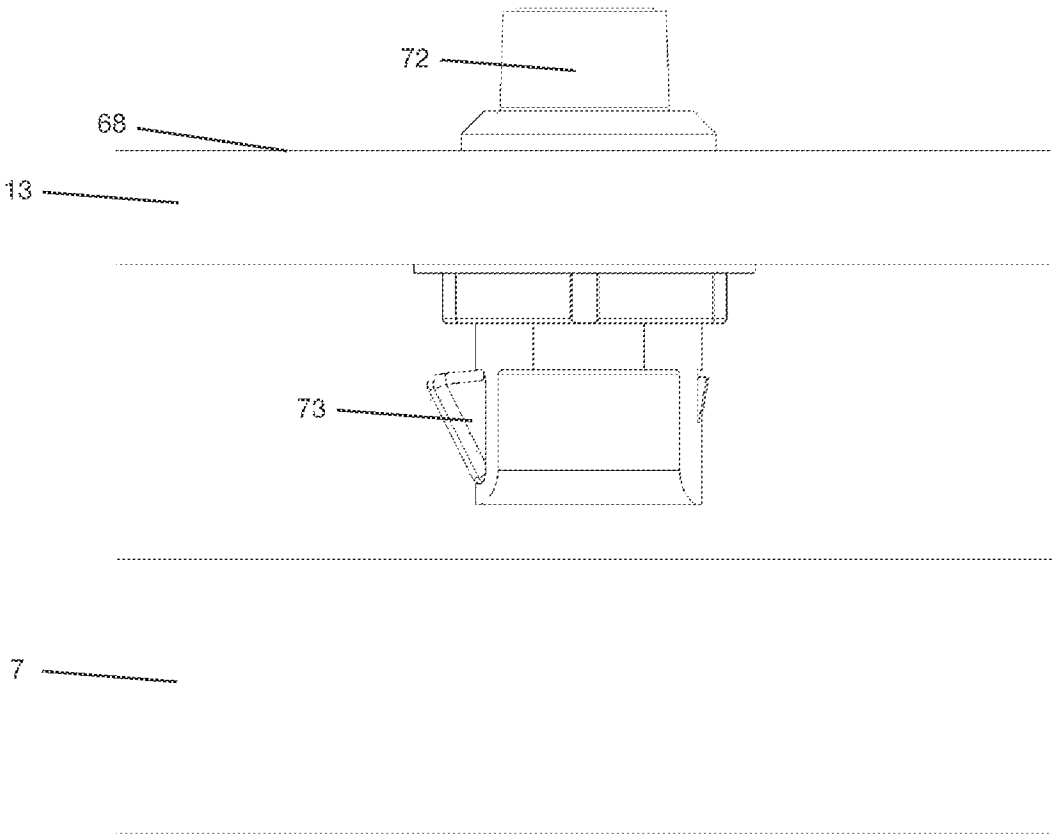

FIG. 32: Front view of alternative locking mechanism in unlocked state.

Figure 33:
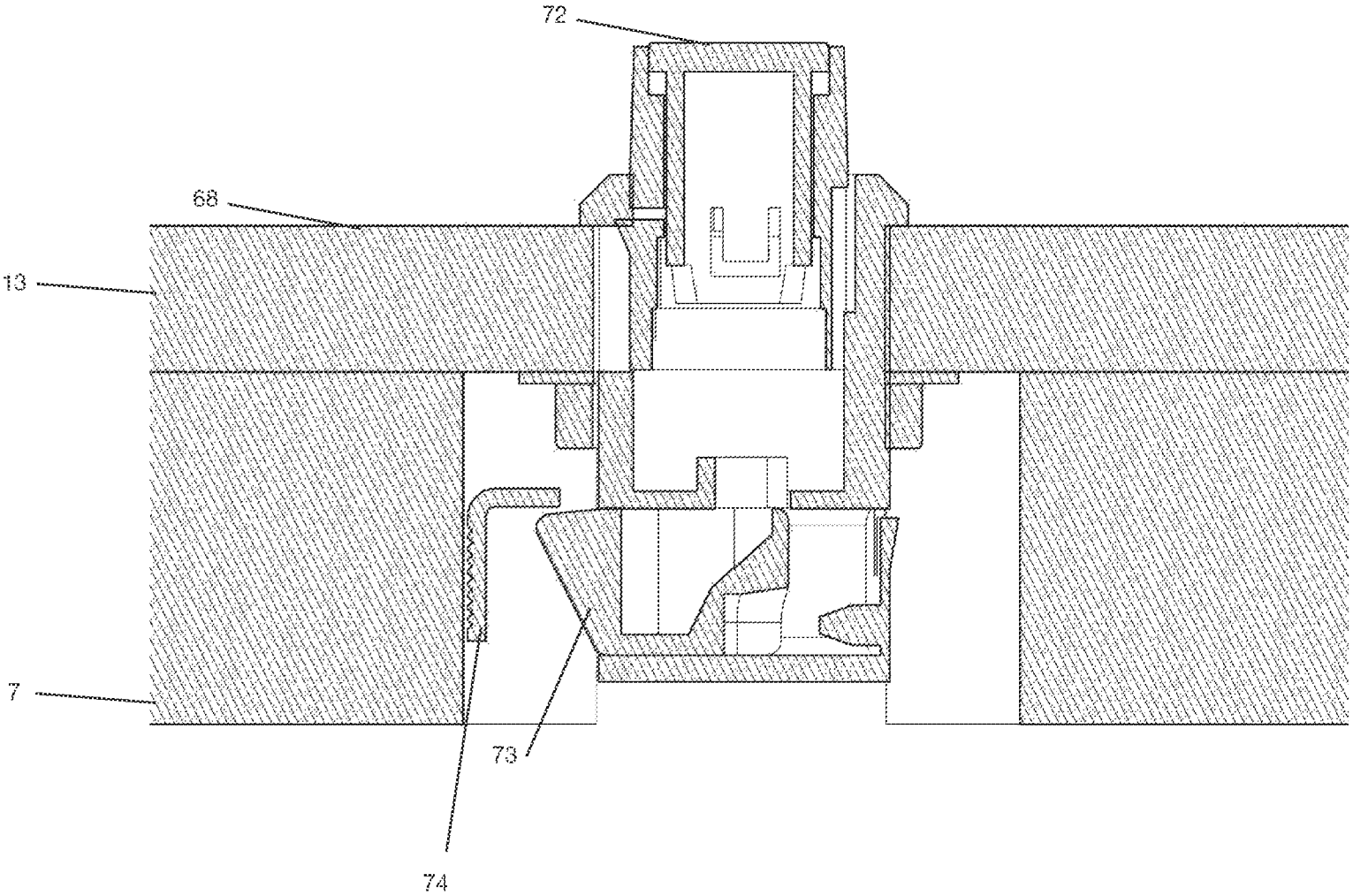

FIG. 33: Section view of alternative locking mechanism in locked state.

Figure 34:
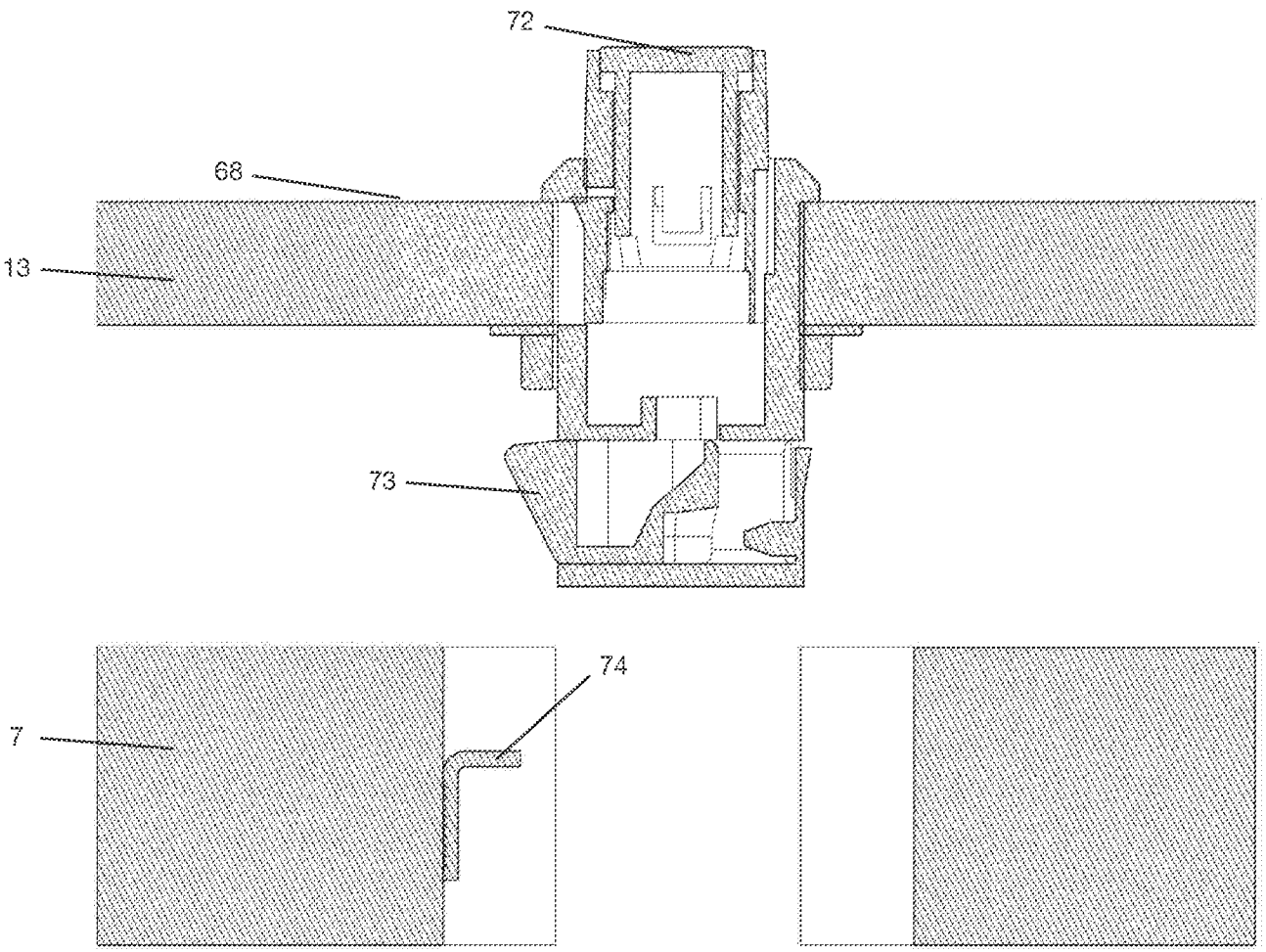

FIG. 34: Section view of alternative locking mechanism in unlocked state.

In accordance with common practice, the various described features are not drawn to scale, but are drawn to emphasize specific features relevant to the invention. Like reference characters denote like elements throughout the figures and text.

DETAILED DESCRIPTION OF THE INVENTION

Following is a list of the piece parts of embodiments of a high chair constructed according to the present invention.

| | |
|---|---|
| 1 | Top |
| 2 | Base |
| 3 | Active Restraint System |
| 4 | Alignment Method |
| 5 | Locking Method |
| 6 | Seat Area |
| 7 | Base Right Lateral Frame |
| 8 | Base Left Lateral Frame |
| 9 | Base Lower Frontal Cross Member |
| 10 | Base Upper Frontal Cross Member |
| 11 | Base Lower Rear Cross Member |
| 12 | Base Upper Rear Cross Member |
| 13 | Top Right Lateral Frame |
| 14 | Top Left Lateral Frame |
| 15 | Top Frontal Cross Member |
| 16 | Top Rear Cross Member |
| 17 | Passive Crotch Restraint/Cross Member |
| 18 | Seat Member |
| 19 | Back Member |
| 20 | Base/Top Latch 1 |
| 21 | Base/Top Latch 2 |
| 22 | Base/Top Axel 1 |
| 23 | Base/Top Axel 2 |
| 28 | Dishwasher Tray |
| 29 | Dishwasher |
| 38 | Left Adjustable Waist Strap |
| 39 | Right Adjustable Waist Strap |
| 40 | Central Adjustable Strap |
| 41 | Curved Seat to accept legs |
| 42 | Space for Hands Below Latch |
| 43 | Space for Hands Above Latch |
| 44 | Space for hands in seat area |
| 45 | Space for hands in seat area 2 |
| 46 | Alignment Indentation Type [ Male |
| 47 | Alignment Indentation Type [ Female |
| 48 | Full High Chair |
| 49 | Three point Restraint Left |
| 50 | Three point Restraint right |
| 51 | Three point Restraint center |
| 52 | Left Mounting Hole for Strap of Active Restraint |
| 53 | Right Mounting Hole for Strap of Active Restraint |
| 54 | Center Mounting Hole fo Strap of Active Restraint |
| 55 | Outer Layer |
| 56 | Inner Layer-Tensile Strength |
| 57 | Alignment Indention Axis 1 |
| 58 | Alignment Indention Type (Female 1) |
| 59 | Alignment Indention Type (Female 2) |
| 60 | Alignment Indention Axis 2 |
| 61 | Latch Hook |
| 62 | Distance line between 7, 8 |
| 63 | Distance line for length of 7, 8 |
| 64 | Distance between 13, 14 |
| 65 | Distance line for length of 13, 14 |
| 66 | Angle between floor and base lateral frame members |
| 67 | Surface of 7 that latch interacts with |
| 68 | Surface of 13 that latch interacts with |
| 69 | Surface of 14 that latch interacts with |
| 70 | Surface of 8 that latch interacts with |
| 71 | Angle between base of the lateral frame members and the upward tapered edge |
| 72 | Push-Button Release |
| 73 | Push-Button Dynamic Protrusion |
| 74 | Push-Button Release Catch |

As shown in FIGS. 1 and 2, a multi-part separable high chair 48, for children according to the first preferred embodiment of the present invention comprises: a top structure 1, which contains a seating area 6 for a child, a base structure 2 disposed beneath the top structure and comprising at least one subassembly to support the top structure 1. A restraint system 3 holds the child in place. An alignment system 4 aligns the top structure 1 and the base structure 2, and a locking device 5 secures the top structure 1 and base structure 2 together for safe use of the high chair. The base structure 2 is generally configured for resting on a floor or other support surface.

As shown in FIGS. 1, 2 and 15, in a first preferred embodiment, the top structure 1 comprises a plurality of members. Two or more laterally spaced-apart side frame members 13, 14 frame the seating area 6 and the overall top structure 1. The frame members 13, 14 are joined by a horizontal seat member 18 that also forms the seat area 6 for the child. A rear vertical restraint member 19 forms a backrest for the child, and a front T-shaped restraint member 17 provides space for a child's legs. A passive restraint system 3 for retaining the child within the high chair is attached to the seat member 18.

The side members 13, 14 extend below a plane of the horizontal seat member 18 to mate with (and locked to) the base structure 2 of the high chair. The side members 13, 14 also extend above the horizontal seat member. Further, the vertical backrest member 19 is entirely above the seat and extends to the upper limit of the side members 13,14.

The T-shaped front restraint member 17 extends obliquely from the plane of the horizontal seat member 18 to proximate an upper edge of the side members 13, 14. A horizontal bar of the T-shaped member is attached to an inner facing surface of side members 13 and 14 while a vertical bar of the T-shaped member is attached to the horizontal seat member 18.

Together, the side members 13, 14, the vertical backrest member 19, and the front restraint member 17 define the seating area 6 for the child. The front member also defines openings in the seating area for receiving the child's legs.

FIG. 3 illustrates a side view of the high chair 48. As shown in FIG. 3, openings 43, 44, 45 are defined in each side member 13, and 14 (although only side member 13 is shown in FIG. 3). These openings provide a hand-hold for easy transport of the chair.

Returning to FIG. 2, two additional cross members 15, 16 (rear and front) connect the side members 13, 14 and thereby provide additional structural support. The front cross member 15 can function as a footrest for the child.

In the first preferred embodiment, a front edge 41 of the seat member 18 defines a dual-curved shape that complements the natural shape of the leg(s) of a human child.

As shown in FIGS. 1, 2, and 21, in the first preferred embodiment, the base structure 2 comprises two or more laterally spaced-apart frame members 7, 8 that form outer lateral sides of the base structure. These side members are joined by cross members, 9, 10, 11, 12 that provide structural integrity to the high chair. Furthermore, as shown in FIG. 3, the side members 7, 8 define openings, such as 42, that provide a hand-hold for easy transport of the chair.

In the first preferred embodiment, both the top and base structures employ common furniture fastening techniques for joining the cross members and frame members together.

In the first preferred embodiment, as shown in FIG. 1, a central adjustable crotch strap 40 is fastened at the junction of the front restraint T-shaped member 17 and the seat member 18. As shown in FIG. 9, the strap 40 is also connected to a female buckle 51 that receives any one of a plurality of male buckles 49, 50 attached to two adjustable waist straps 38, 39 respectively. The adjustable waist straps 38, 39 are affixed to the bottom surface of the seat member 18.

As shown in FIG. 9, components 38, 39, 40, 49, 50, 51 comprise an embodiment of the active restraint system 3 (currently required for all high chairs in the United States according to ASTM-F404 regulations) in the form of a 3-point restraint, as known in those skilled in the art. In other embodiments the restraint system comprises a 5-point restraint, as known by those skilled in the art. In still other embodiments, another approved restraint system may be used or a restraint system may not be present if available only outside the United States.

The straps 38, 39, 40 of the active restraint system comprise a plurality of layers that provide both strength and washdown environment compatibility. As shown in the cross-sectional view of FIG. 10, the strap 39 comprises an inner layer 56 made from a material with high tensile strength, such as Nylon, that provides strength and guarantees safety even at high temperatures of up to 200 F, and an outer layer 55, made from a material that can withstand washdown environments and temperatures of up to 200 F, such as silicone, that protects the inner layer 56 from deterioration; the outer layer also prevents chronic particulate accumulation, as the outer layer can be easily cleaned in a washdown environment, such as a commercial dishwasher.

In the first preferred embodiment, the top structure 1 is mated with the base structure 2, such that when mated, a correct orientation is guaranteed. As shown in FIG. 13, in the first preferred embodiment, this mating system comprises a protrusion 46 (or raised edge) that extends from each of the side frame members 7, 8, of the base structure 2. (See FIG. 1). A complementary recess (or opening) 47 is defined in each side member 13, 14 of the top structure 1 (see FIG. 1). As shown in FIGS. 14A and 14B, these complementary shapes mate to prevent the top and bottom structures 1, 2 from moving in the direction denoted by a directional arrowhead 57 shown in FIG. 13. Also see FIG. 21, a perspective view of bottom subassembly.

This alignment system described immediately above aligns the top and bottom structures 1, 2 on one axis or in one direction. However, for better alignment and to provide self-aligning capability, additional alignment techniques and components that restrict movement in more than one direction and aid in centering the top and bottom structures are present in a second embodiment. In a similar fashion, additional complementary shapes 58, 59 (notches for example)(see FIG. 13) are defined within top corners of the upper cross members for mating with an upper edge or surface of the cross members 10, 12. Mating of these elements restricts movement along axis 60, as shown in FIG. 12, and axis 57 shown in FIG. 13. Thus, with this alignment system, movement by the top and bottom structures 1, 2 is prevented and these two structures are safely aligned.

A locking mechanism 5 accompanies either of the described alignment systems to mechanically secure the top structure to the base structure when the high chair is in use by a child.

In one preferred embodiment, as shown in FIGS. 1, 2, and 16, this locking system is a variation of a draw or tension latch, which operates by pulling two surfaces together into contact then securing the surfaces in that configuration. The system comprises two latches 20, 21, (see FIG. 1) that are pivotably affixed to the top structure 1 and can pivot around axes 22, 23. See FIGS. 16A, 16B, which are section views. The latches define a hooked shape that creates resistance to disengagement when engaged with frame members 7, 8 on surfaces 67, 70 in the bottom structure 2 and frame members 13, 14 on surfaces 68, 69 in the top structure 1. This engagement action is a safety mechanism and can be seen clearly in FIGS. 12 and 16. The latches 20, 21 use compressive forces exerted on surfaces 67, 70, 68, 69 on respective lateral members 7, 8, 13, 14 to minimize play and prevent disengagement of the mating members. The protrusion 61 extending from a front surface of each latch shown in FIG. 16C prevents disengagement.

In another embodiment, the locking system engages when mating components are pushed together, without the need for additional steps to activate the locking system. The locking system releases only when the user actuates a release element. While this locking system is present on both sides of the high chair, operation on only one side, with associated reference numerals, is described.

As seen in FIG. 31, the locking system comprises a push-button release 72 located on surface 68 of lateral frame member 13, the remainder of the locking mechanism is embedded in the lateral frame member 13.

FIG. 31 shows the locking mechanism engaged with bottom lateral frame member 7. FIG. 32 depicts the members 7 and 13 separated to reveal that segment of the push button lock that would otherwise be within 7 and therefore hidden from view. The section view of FIG. 33 shows members 7 and 13 in contact and the hidden segment of the push button within member 7. The FIG. 33 section view reveals a push-button protrusion 73 which is spring loaded such that it defaults to this locked position and prevents members 7 and 13 from separating due to a push-button catch 74, which is embedded in lateral frame member 7.

To release, a user actuates the mechanism (in one embodiment in the form of a button) and releases the spring-load. Upon actuation, the protrusion 73 is retracted from the catch 74, such that members 7 and 13 can be decoupled. See FIG. 34.

This same locking system is mounted on the lateral members 8 and 14 (the other side of the high chair) as well.

Figure 30:
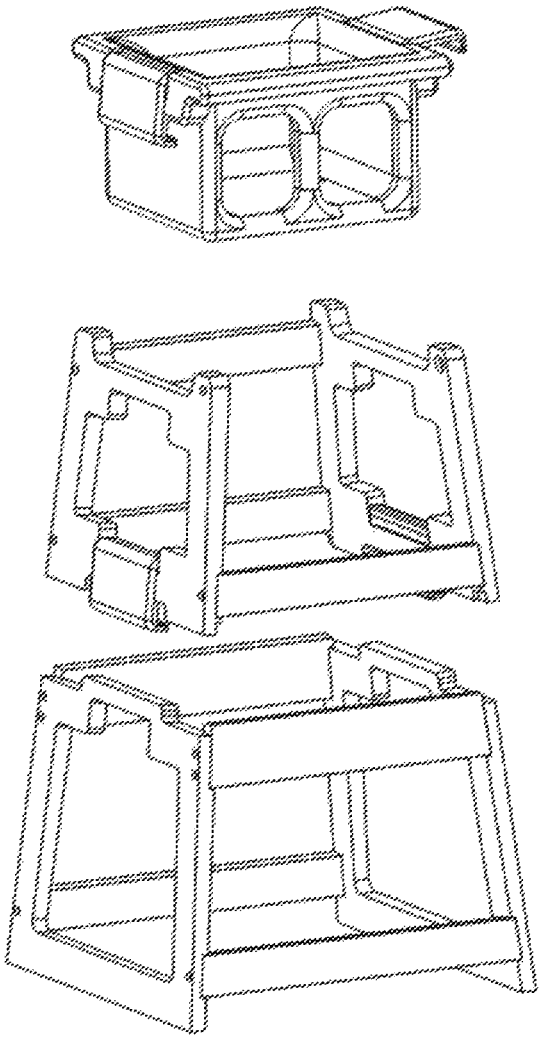

In another embodiment as illustrated in FIG. 30, a top structure is further segregated into a plurality of components: in this case, a seat and a middle section. For use in a commercial dishwasher, the entire top structure (seat and middle section) is nested within the base structure, in the same manner as the preferred embodiment as described herein. In this embodiment, however, the seat alone can be removed for cleaning if a full high chair clean is unnecessary. The seat is aligned with its corresponding middle section via the same alignment and locking mechanisms described elsewhere herein.

The alternative embodiment is also shown in:

FIG. 26: Seating area and locking mechanism of an alternative embodiment.

FIG. 27: Partially disengaged locking mechanism on an alternative embodiment.

FIG. 28: Front view of partially disengaged locking mechanism on an alternative embodiment.

FIG. 29: Exploded perspective view of an alternative embodiment with top subassembly detached.

As shown in FIG. 17, in a preferred embodiment, there is space between side members 7, 8 of the base structure 1, that is large enough and tapered in such a way that it can receive the top structure 2 such that it fits entirely within the bottom structure's volumetric footprint thereby providing a nesting capability. Additionally, this structural and dimensional relationship between the top and bottom structures provides the capability for multiple high chairs to be stacked on top of each other, as shown in FIG. 20.

According to the descriptions above, to permit the key functionalities of the high chair 48, and its use in a commercial dishwasher (FIG. 24), there are some key dimensional and material constraints that have to be considered. A typical washing area in a commercial dishwasher (FIG. 41) has a height of 17". The tray 28 (FIG. 19) which supports materials in the dishwasher and standardizes the dishwashing process has a base area of 18.5" by 18.5". Further, commercial dishwashers typically reach a maximum operating temperature of 200 degrees Fahrenheit and expose materials that are being washed to harsh industrial sanitizing chemicals, ranging from dish soap to degreasing solvents. See also FIG. 22. a perspective view of typical dishwasher boundary with typical dishwashing tray and see FIG. 23, a front view of high chair in its secondary use state in a dishwasher. tray within typical commercial dishwasher boundaries.

Further, there are important constraints that a high chair must satisfy to function in its primary use as a typical high chair at a table supporting a child. Due to these constraints, the seat 18 is 18"-26" from the floor, the high chair 48 supports the weight of a child under 3 years of age and resists tipping during standard use. The seat area 6 also fits and supports a child under 3 years of age.

In FIG. 6, the distance between lateral frame members 7, 8 as denoted by line 62 and the length of the lateral frame members 7, 8 as denoted by line 63 cannot exceed 18.5 inches. This constrains the footprint of the chair to an area of 18.5"×18.5" such that it fits in a standard dishwasher tray 28. A standard dishwasher has a clearance of 17" and as such, the height from the floor to the uppermost point of the base subassembly 2 does not exceed that limit. See also FIG. 7, a bottom view of the high chair constructed according to the teachings of the present invention.

Similarly, as shown in FIG. 8, to fit in a standard dishwasher, the top assembly 1 has similar constraints, with the distance between the top lateral frames 13, 14 as denoted by line 64 and the length of lateral frame members 13, 14 as denoted by line 65 not exceeding 18.5". The height of sub assembly 1 also does not exceed 17". See also FIG. 15, a perspective view of top subassembly As shown in FIG. 18, the dimensions at the bottom of the base structure 1 is smaller than the dimensions of a standard dishwashing tray 28 to facilitate washing of the high chair in standard commercial sanitation units, of which the boundaries are denoted by reference numeral 29.

For the high chair 48 to fit into a commercial dishwasher, the high chair breaks down into a plurality of pieces 1, 2, (upper and lower segments) which can nest within one another, and when nested, the combination has an outer dimensions that does not exceed the dimensional constraints of the dishwasher. The key high chair dimensions which affect its ability to stack multiple chairs on top of each other, nest within itself, and the size of its nested manifestation, and which allow it to function in its primary use as a high chair are material thickness, angle 66 of the lateral frame members 7, 8 relative to the floor, angle 71 between base structure 2 of the lateral frame members 7, 8 and the upward tapered edge of lateral frame members 7, 8, the height of the high chair 48 above the floor, and the size of seating area 6.

Specifically, with a fixed floor footprint of 18.5" by 18.5", and a total high chair height suitable for use at a typical restaurant table, as the angles 66, 71 (see FIG. 3 and FIG. 4 and FIG. 5) between the floor and the lateral frame members 7, 8 decreases, the seating area size 6 shrinks and the high chair 48 becomes more stable. The opposite is also true. Further, as material thickness increases, the open volume within subassembly 2 decreases. Thus, the angles 66, 71 need to be decreased to allow for nesting and stacking. So there is a combination of material thickness and an angle between the floor and side panels which when combined properly, allow the high chair to have a sufficiently small footprint to fit in the dishwasher, to have a sufficiently large enough seating area size, and tall enough to be able to be used at a typical dining table. The angles 66, 71 also have to be small enough to provide enough stability for the high chair when in use and the material thickness large enough to provide the structural support necessary for a seated child.

FIG. 11 is an exploded front view of high chair separated into subassemblies in preparation for a secondary use state, i.e., loading into the dishwasher.

A material is chosen, which at a low enough thickness to satisfy the dimensional constraints of the dishwasher and the key functionality of the high chair, must be strong and rigid enough to provide the structural support necessary to support the weight of a small child without buckling and enable the described locking mechanisms to function properly between the subassemblies 1, 2. Additionally, this material must also be able to withstand the intense washdown environment of the dishwasher. These constraints taken together require careful and precise mechanical design.

Exemplary materials are described below.

Plastic:

Polypropylene (PP): This type of plastic is generally considered safe for use with food and by extension, safe for use around children. It is often used in sippy cups, baby bottles, and food containers. The dishwasher trays are also made from this material.

High-Density Polyethylene (HDPE): This plastic is also considered safe and is used widely in products that come into contact with food, such as milk jugs and water bottles. It is also used in children's toys. HDPE can also withstand the high heat and is commonly used in furniture applications.

Metal:

Aluminum: While not as lightweight as plastic, aluminum is a recyclable material that is able to maintain structural integrity when used in a furniture items, and can also withstand the high temperatures of a dishwasher. Also, aluminum is corrosion resistant.

Stainless Steel: A heavy material, but corrosion resistant

Ceramic:

Though impractical, ceramic is able to withstand the high heat of the dishwasher and also maintain structural integrity.

Composites of these materials can also be used to construct the high chair of the present invention Theoretically, a composite or hybrid construction using a variety of suitable materials is also possible.

What is claimed is:

1. A high chair comprising:

a base structure for resting on a support surface, the base structure comprising upstanding structural members tapering inwardly and upwardly from a bottom region;

a top structure comprising upstanding structural members tapering inwardly and upwardly from a bottom region, the top structure for setting atop and in contact with the base structure;

a first alignment element in a structural member of the top structure for mating with a second alignment element in a structural member of the base structure;

a coupling mechanism for removably coupling the top structure and the base structure;

the top structure comprising a substantially horizontal seat upon which a child can sit; and wherein the top and base structures are dimensioned to allow the top structure to nest within a volume defined by the base structure.

2. The high chair of claim 1, wherein the base and the top structure are dimensioned to allow stacking of a plurality of high chairs by nesting a top structure of a first high chair within a base of a second high chair.

3. The high chair of claim 1, wherein dimensions of a footprint of the base structure are less than 23 inches by 23 inches and a height of the base structure is less than 23 inches.

4. The high chair of claim 1, wherein the first alignment element comprises a first shape defined within a first structural member of the top structure and the second alignment element comprises a complimentary second shape defined within a first structural member of the base structure, wherein mating the first shape and the complimentary second shape aligns the top structure and the base structure.

5. The high chair of claim 4, further comprising a third shape within a second structural member of the top structure and complimentary fourth shape within a second structural member of the base structure, wherein mating the third shape and the complimentary fourth shape aligns the top structure and the base structure, wherein the first structural member of the top structure and the first structural member of the base structure are in a spaced-apart opposing relation relative to the second structural member of the top structure and the second structural member of the base structure.

6. The high chair of claim 1, wherein the coupling mechanism comprises a first and a second U-shaped element, the first and second U-shaped element rotatably attached to a structural member on each of opposing sides of the top structure, wherein rotation of each one of the first and second U-shaped elements captures a respective structural member on each one of opposing sides of the base structure.

7. The high chair of claim 6, wherein frictional forces retain the first and second U-shaped elements in an engaged state with the respective base structural members.

8. The high chair of claim 1, further comprising a T-shaped child restraint system comprising a horizontal bar segment disposed between spaced-apart and opposing structural members of the top structure and comprising a vertical bar segment disposed between the horizontal bar segment and the seat.

9. The high chair of claim 1, further comprising a safety strap affixed to opposing left and right side surfaces of the top structure for restraining a child on the seat, the strap comprising an inner layer material exhibiting a high tensile strength and an outer layer material capable of withstanding water spray, harsh chemicals used in a dishwashing or sanitizing environment, and temperatures to 200 F present in a dishwasher during a wash cycle.

10. The high chair of claim 9, wherein the harsh chemicals comprise acids, bases, fats, organic solvents, detergents, rinse aids, and chemical sanitizers.

11. The high chair of claim 1, wherein the first and second alignment mechanisms comprise first and second spaced-apart and opposing structural members of the base structure that define a convex shape for mating with respective complementary concave shapes defined in first and second spaced-apart and opposing structural members of the top structure, thereby aligning the base and top structures.

12. The high chair of claim 1, wherein a material of the base and top structures comprises polypropylene, high-density polyethylene, aluminum, stainless steel, ceramic or any composite thereof.

13. The high chair of claim 1, wherein the upstanding structural members of the base structure comprise four upstanding structural members configured to form a rectangular footprint of the base structure, and wherein the upstanding structural members of the top structure comprise four upstanding structural members configured to form a rectangular footprint of the top structure, and wherein the rectangular footprint of the base structure is larger than the rectangular footprint of the top structure.

14. The high chair of claim 1, wherein the coupling mechanism comprises a push button coupling mechanism further comprising a push button segment disposed on a first structural member of the top or base structure and a locking segment disposed in a second structural member of an other of the top and base structures, wherein the locking segment engages a release catch in the second structural member to couple the first and second structural members, and wherein activation of the push button releases the catch and decouples the top and base structures.

* * * * *